US009227808B2

(12) United States Patent
Gentile et al.

(10) Patent No.: US 9,227,808 B2
(45) Date of Patent: Jan. 5, 2016

(54) MATERIAL FEEDING APPARATUS WITH GRIPPING MEMBER LINKAGE AND METHOD OF OPERATION

(75) Inventors: Joseph P. Gentile, Longboat Key, FL (US); Bryan P. Gentile, Longboat Key, FL (US); Vaughn H. Martin, Mars, PA (US)

(73) Assignee: Vamco International, Inc., Pittsburgh, PA (US)

( * ) Notice: Subject to any disclaimer, the term of this patent is extended or adjusted under 35 U.S.C. 154(b) by 740 days.

(21) Appl. No.: 13/504,287

(22) PCT Filed: Nov. 1, 2010

(86) PCT No.: PCT/US2010/054969
§ 371 (c)(1),
(2), (4) Date: Sep. 20, 2012

(87) PCT Pub. No.: WO2011/053911
PCT Pub. Date: May 5, 2011

(65) Prior Publication Data

US 2013/0013098 A1 Jan. 10, 2013

Related U.S. Application Data

(60) Provisional application No. 61/256,556, filed on Oct. 30, 2009.

(51) Int. Cl.
*B21D 43/00* (2006.01)
*B65H 20/18* (2006.01)
*B21D 43/10* (2006.01)

(52) U.S. Cl.
CPC ..... *B65H 20/18* (2013.01); *B21D 43/10* (2013.01); *B65H 2701/173* (2013.01)

(58) Field of Classification Search
None
See application file for complete search history.

(56) References Cited

U.S. PATENT DOCUMENTS

| | | | |
|---|---|---|---|
| 3,289,507 | A | 12/1966 | Grewe |
| 3,707,255 | A | 12/1972 | Ridgway et al. |
| 4,048,833 | A | 9/1977 | Lorenz |
| 4,106,324 | A | 8/1978 | Gotz |

(Continued)

FOREIGN PATENT DOCUMENTS

| | | |
|---|---|---|
| CN | 1903505 | 1/2007 |
| CN | 101214691 | 7/2008 |
| JP | 4975178 | 6/1974 |

OTHER PUBLICATIONS

First Office Action related to Chinese Patent Application No. 201080055977.3 dated May 15, 2014.

(Continued)

*Primary Examiner* — Sean Shechtman
*Assistant Examiner* — Steven Garland

(57) ABSTRACT

A gripper type material feeding apparatus for the intermittent feeding of a workpiece. The apparatus includes a first linearly guided gripper mechanism which is movable in a first direction of feeding and in a second direction opposite to the first direction. The first gripper mechanism includes a first gripping member and a second gripping member wherein the second gripping member is movable relative to the first gripping member for gripping the workpiece. The apparatus includes a first release actuator for moving the second gripping member of the first gripper mechanism in a direction relative to the first gripping member of the first gripper mechanism.

27 Claims, 20 Drawing Sheets

(56) References Cited

U.S. PATENT DOCUMENTS

| | | | | |
|---|---|---|---|---|
| 4,549,683 | A | 10/1985 | Kato | |
| 4,552,294 | A | 11/1985 | Rotzler | |
| 4,558,809 | A | 12/1985 | Schoen | |
| 4,577,483 | A | 3/1986 | Rehag et al. | |
| 4,577,791 | A | 3/1986 | Leinhaas | |
| 4,667,531 | A | 5/1987 | Kato et al. | |
| 4,718,589 | A | 1/1988 | Nelson | |
| 4,784,561 | A | 11/1988 | Cartry et al. | |
| 4,819,850 | A | 4/1989 | Kato | |
| 5,033,342 | A | 7/1991 | Nordlof | |
| 5,177,992 | A * | 1/1993 | Aoki et al. | 72/420 |
| 5,392,977 | A | 2/1995 | Kato | |
| 5,505,360 | A | 4/1996 | Giusto | |
| 5,632,430 | A | 5/1997 | Kato | |
| 5,909,835 | A | 6/1999 | Zanette | |
| 6,182,880 | B1 | 2/2001 | Dotey | |
| 6,213,369 | B1 | 4/2001 | Kato | |
| 6,283,352 | B1 | 9/2001 | Messner et al. | |
| 6,530,511 | B2 | 3/2003 | Garcia et al. | |
| 7,131,362 | B1 | 11/2006 | Matsuda et al. | |
| 7,229,380 | B2 | 6/2007 | Kato | |
| 7,275,405 | B2 | 10/2007 | Bultmann | |
| 2013/0006410 | A1 | 1/2013 | Gentile et al. | |

OTHER PUBLICATIONS

First Office Action related to Chinese Patent Application No. 201080055979.2 dated Jan. 28, 2014.

Second Office Action related to Chinese Patent Application No. 201080055979.2 dated Nov. 15, 2014.

Office Action related to Japanese Patent Application No. 2012537168 dated Oct. 1, 2014.

International Search Report corresponding to PCT/US2010/54969 dated Dec. 30, 2010.

* cited by examiner

MATERIAL FEEDING APPARATUS WITH GRIPPING MEMBER LINKAGE AND METHOD OF OPERATION

CROSS-REFERENCE TO RELATED APPLICATION

This application is a national phase application pursuant to 35 U.S.C. §371 of International Application No. PCT/US2010/054969, filed Nov. 1, 2010, which itself claims the benefit under 35 U.S.C. 119 §(e) of the earlier filing date of U.S. Provisional patent application No. 61/256,556 filed on Oct. 30, 2009, which is hereby incorporated by reference.

FIELD OF INVENTION

The present invention relates generally to a material feeding apparatus, and particularly to a gripper type material feeding apparatus for intermittently feeding a workpiece, such as a strip-like material, a wire material, or the like, to a stamping machine or similar machine.

BACKGROUND OF THE INVENTION

Existing gripper type material feeding devices utilize a movable linearly guided gripper mechanism for feeding a strip-like workpiece. Such gripper style feeding apparatus typically utilize cams for the actuation of the opening or closing function of the gripper mechanisms to clamp and unclamp the material. Such devices are exemplified in U.S. Pat. Nos. 6,283,352 and 6,213,369. Such devices utilize a linkage arrangement or other transmission elements between the cam actuator and the gripper mechanism having a pivot axis which is parallel to the direction of workpiece motion. The disadvantage of such arrangements is that a linear sliding or linear rolling motion must be provided somewhere between the actuator and the linearly guided gripper mechanism to allow unconstrained feeding motion. This linear sliding or linear rolling motion suffers from high wear characteristics and high maintenance costs. Furthermore, mechanical adjustments are necessary to modify the timing of the opening or closing function of the gripper mechanism, or to modify the gap between the gripping members of the gripper mechanism for adaptation to different workpiece thicknesses.

Other existing gripper type material feeding devices utilize pneumatic or hydraulic cylinders for the actuation of the opening or closing functions of the gripper mechanisms. Examples of such devices are seen in U.S. Pat. Nos. 5,505,360 and 5,909,835. In such devices the cylinder actuator is transported on the linearly guided gripper mechanism. The disadvantage of such devices is that additional mass of the moving actuator limits the operational speed of the feeding device.

There exists then the need for a gripper type material feeding apparatus which does not require a sliding or rolling connection between a linearly guided gripping mechanism and the actuator for the opening or closing function of the gripping mechanism. Furthermore there exists the need for a gripper type material feeding apparatus which may utilize an actuator of high power capacity to facilitate high gripping forces and where the actuator need not be located on and moving with the gripper mechanism thereby allowing a lightweight construction of the gripper mechanism for operation at high speeds.

Furthermore there exists a need for a gripper type material feeding apparatus which does not require mechanical adjustments to modify the timing relationship between the opening or closing function of the gripper mechanisms to facilitate the piloting function of the press tooling, or to modify the gap between the gripping members of the gripper mechanisms for adaptation to different workpiece thicknesses.

SUMMARY OF THE INVENTION

In one general aspect, this application discloses an apparatus for the intermittent feeding of a workpiece. Specifically, the apparatus includes a first linearly guided gripper mechanism which is movable in a first direction of workpiece feeding and in a second direction opposite to the first direction. The first gripper mechanism includes a first gripping member and a second gripping member wherein the second gripping member is movable relative to the first gripping member for gripping the workpiece. The apparatus includes a first release actuator for moving the second gripping member of the first gripper mechanism in a direction relative to the first gripping member of the first gripper mechanism. The apparatus includes a first release connecting link with a first end pivotally connected at a first pivot axis to the first release actuator and with a second end pivotally connected at a second pivot axis to the second gripping member of the first gripper mechanism. The second pivot axis of the first release connecting link is movable in the first direction of workpiece feeding and the second direction opposite to the first direction.

BRIEF DESCRIPTION OF THE DRAWINGS

For the present invention to be clearly understood and readily practiced, the present invention will be described in conjunction with the following figure, wherein like reference characters designate the same or similar elements, which figure is incorporated into and constitutes a part of the specification, wherein.

DETAILED DESCRIPTION OF THE INVENTION

Figure 1:
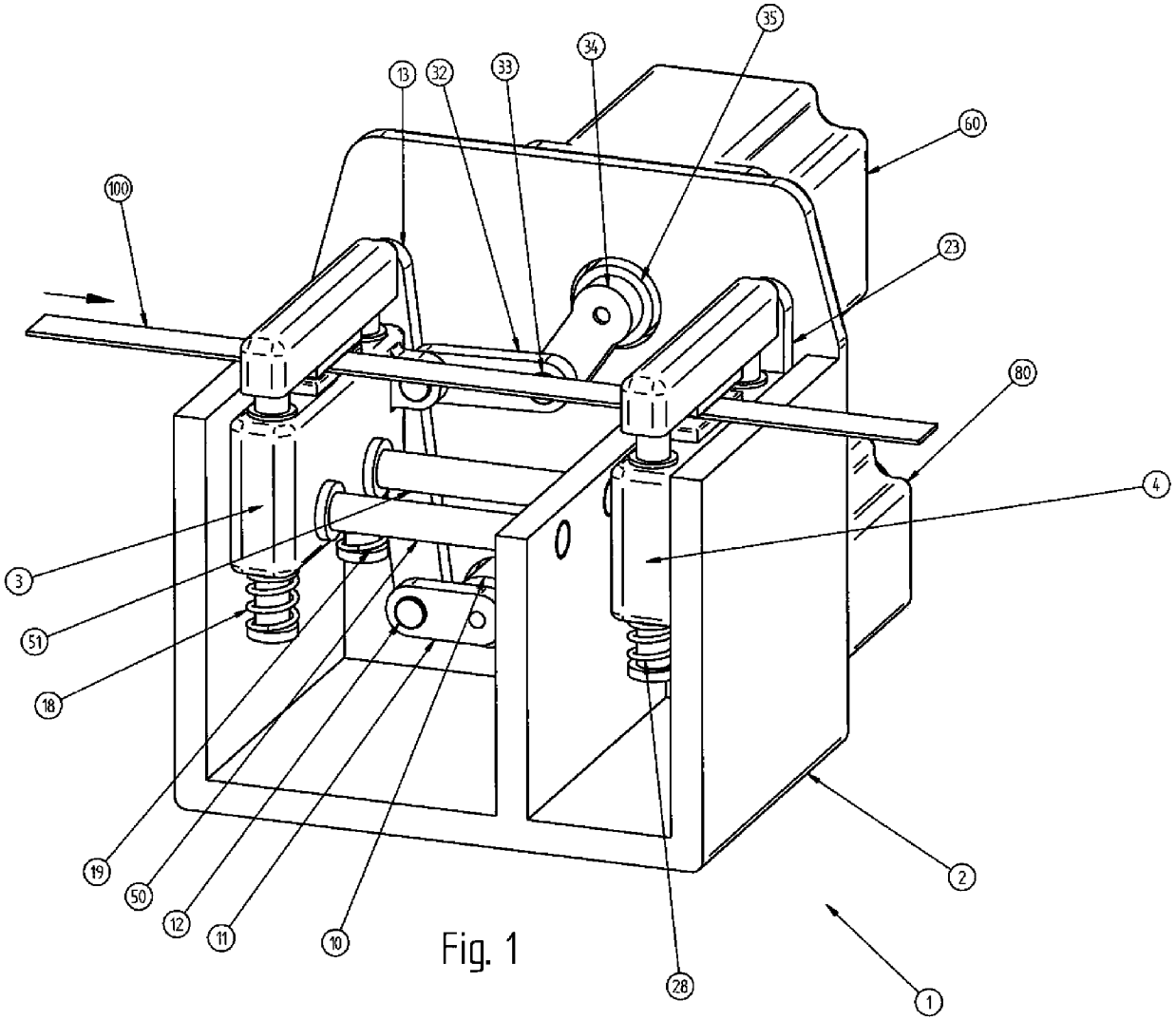
FIG. 1 is a front perspective view of a gripper type material feeding apparatus according to an embodiment of the invention.
Figure 2:
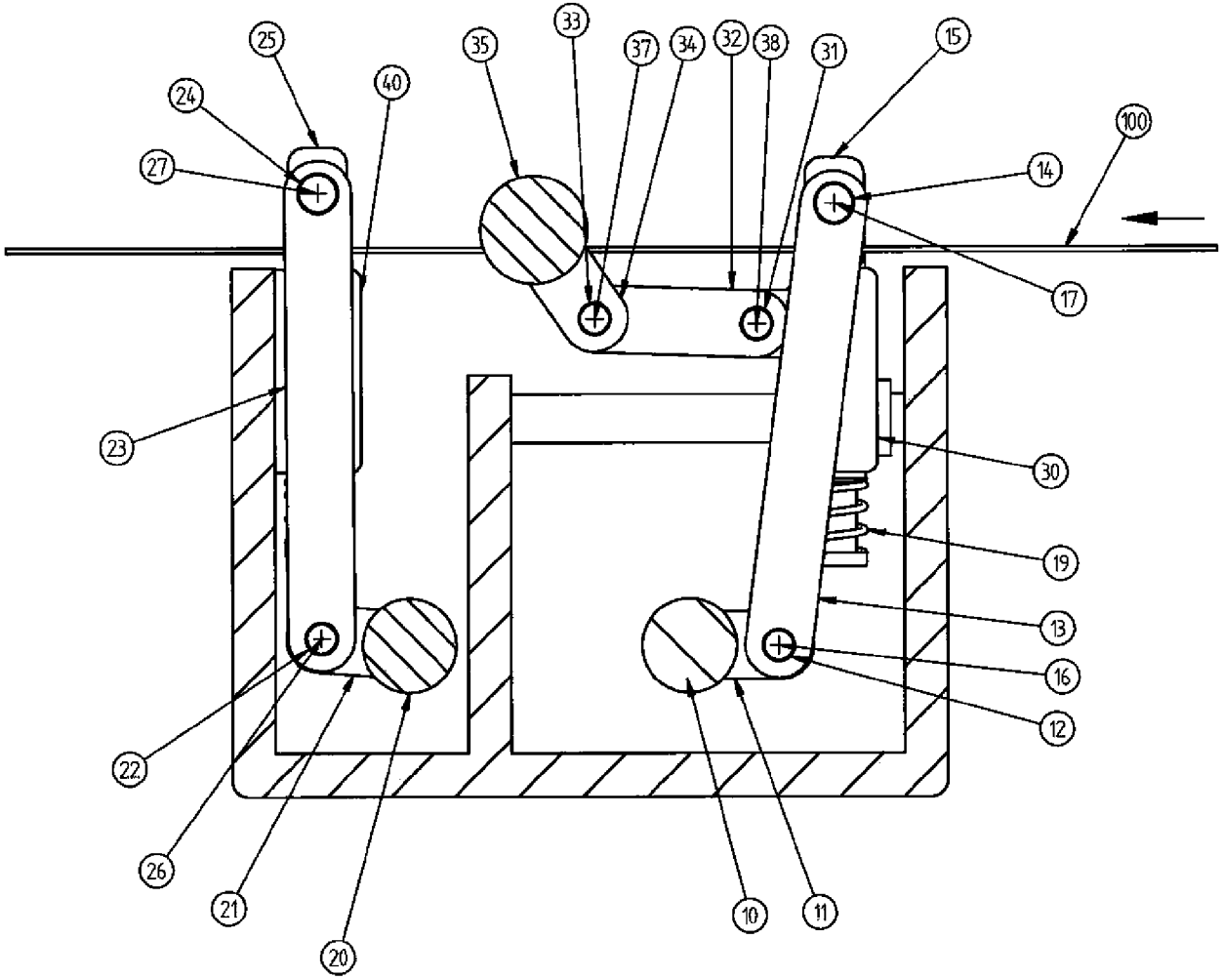
FIG. 2 is a rear cross-sectional view of the apparatus of FIG. 1.

It is to be understood that the figures and descriptions of the present invention have been simplified to illustrate elements that are relevant for a clear understanding of the invention, while eliminating, for purposes of clarity, other elements that may be well known. Those of ordinary skill in the art will recognize that other elements are desirable and/or required in order to implement the invention. However, because such elements are known in the art, and because they do not facilitate a better understanding of the present invention, a discussion of such elements is not provided herein. The detailed description will be provided herein below with reference to the attached drawings.

For purposes of the description hereinafter, the terms "upper", "lower", "vertical", "horizontal", "axial", "top", "bottom", and derivatives thereof shall relate to the invention, as it is oriented in the drawings. However, it is to be understood that the invention may assume various alternative configurations except where expressly specified to the contrary. It is also to be understood that the specific elements illustrated in the drawings and described in the following specification are simply exemplary embodiments of the invention. Therefore, specific dimensions, orientations and other physical characteristics related to the embodiments disclosed herein are not to be considered limiting.

It is to be further understood that the phrase "generally perpendicular to" should not be interpreted in the strictest limitation of perpendicularity, that is, the requirement that two perpendicular lines must intersect. Rather, the phrase "generally perpendicular to" is used to allow for the possibility that the described elements are arranged in such ways that even though the axis or directions of reference may be skew, or non-intersecting, the projection of the axis and or directions onto a projection plane parallel to both axis and or directions will result in projection lines which are perpendicular. Furthermore the phrase "generally perpendicular to" is to be understood as being an orientation close to 90 degrees, for example 85-95 degrees.

It is here to be noted that although the following description of various linkage arrangements and their operation are described in singular, for example driving members and connecting links, any such elements may be present in duplicate where the construction and operation are parallel. Such arrangements shall not be considered outside the scope of the present invention.

An embodiment in accordance with the present invention will be described below with reference to the accompanying drawings. FIGS. 1-9 show a structure and operation of a feeding apparatus with an embodiment of the present invention. The described embodiment of the feeding apparatus feeds a workpiece such as metal sheets or wire, or the like to a press machine, stamping machine or the like. It should be understood that the feeding apparatus may be used with other materials or in combination with other types of machines requiring the intermittent feeding of a workpiece.

A feeding apparatus 1, depicted generally in FIG. 1, is provided with a frame 2.

A workpiece 100 is illustrated and a first direction of workpiece feeding is depicted with a direction arrow.

A first gripper mechanism 3 is supported by and configured for linear movement along linear guides 50 and 51. Linear guides 50 and 51 are supported by frame 2 and stationary relative thereto. In the illustrated embodiment, linear guides 50 and 51 are parallel cylindrical rods. Linear guides 50 and 51 are arranged parallel to the direction of workpiece feeding. First gripper mechanism 3 is therefore linearly guided and movable in a first direction of workpiece feeding and in a direction opposite to the first direction of workpiece feeding.

First gripper mechanism 3 comprises a first gripping member 30 and a second gripping member 15. Second gripping member 15 is movable relative to first gripping member 30. Further, in this embodiment, first gripper mechanism 3 further comprises a first spring 18 and a second spring 19. First and second springs 18 and 19 are arranged for urging second gripping member 15 toward gripping member 30. Alternatively either first spring 18 or second spring 19 or both may be omitted.

A second gripper mechanism 4 is supported by frame 2 and stationary relative thereto. Second gripper mechanism 4 comprises a first gripping member 40 and a second gripping member 25. Second gripping member 25 is movable relative to first gripping member 40. Further, in this embodiment, second gripper mechanism 4 further comprises a first spring 28 and a second spring 29. First and second springs 28 and 29 are arranged for urging second gripping member 25 toward gripping member 40. Alternatively either first spring 28 or second spring 29 or both may be omitted.

Figure 9:
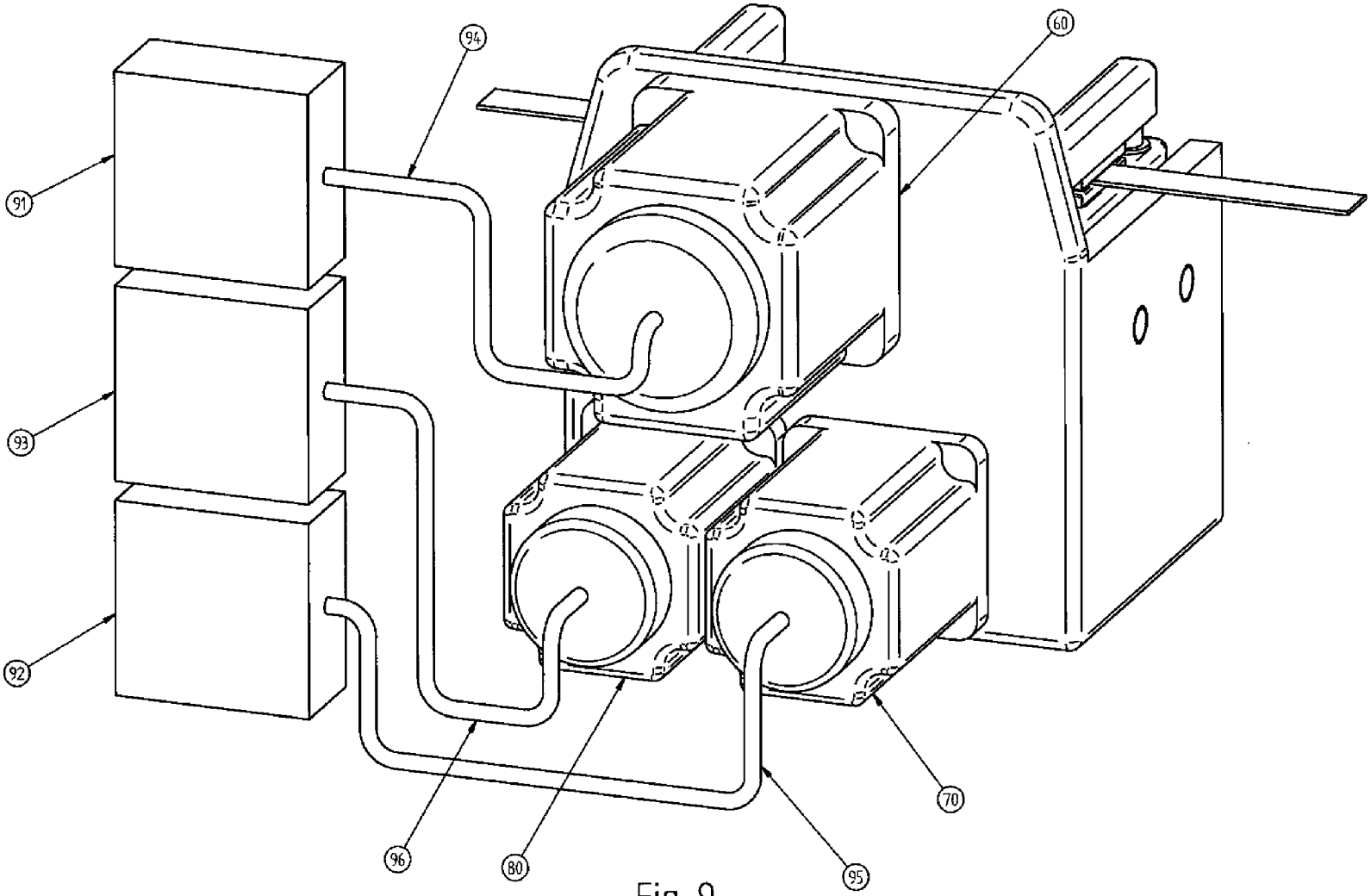
FIG. 9 is a rear perspective view of the apparatus of FIG. 1.

A gripper mechanism drive actuator 60 is supported by frame 2 and stationary relative thereto. Gripper mechanism drive actuator 60 is angularly adjustable, reversible and rotary. Gripper mechanism drive actuator 60 is preferably a brushless permanent magnet electric servo motor. Alternatively, gripper mechanism drive actuator 60 may be a stepper motor, a hydraulic motor, a rotary pneumatic actuator, or any reversible rotary actuator that may be adjustable in angle of rotation. Gripper mechanism drive actuator 60 is controlled by a programmable controller 91 (FIG. 9). Programmable controller 91 is configured for adjusting the rotation angle of the gripper mechanism drive actuator 60. The rotation angle of gripper mechanism drive actuator 60 is therewith controlled and thereby adjustable. That is, gripper mechanism drive actuator 60 is an angularly adjustable, reversible and rotary actuator. Programmable controller 91, depicted generally in the drawings is of conventional design well known in the art. Programmable controller 91 is connected to gripper mechanism drive actuator 60 with a wire 94.

A drive link or driving member 34 is connected to output shaft 35 of gripper mechanism drive actuator 60 for rotation therewith. Driving member 34, being connected to output shaft 35 for rotation therewith, rotates about a rotation axis 36 of output shaft 35. It should be noted that while driving member 34 is shown as a separate component from output shaft 35 of gripper mechanism drive actuator 60, driving member 34 could be constructed as an integral part of output shaft 35, such as an eccentric feature of output shaft 35.

A gripper mechanism drive connecting link 32 is pivotally connected at a first end by connecting pin 33 to a first end of driving member 34 at a first pivot axis 37 and at a second end by connecting pin 31 to movable gripper mechanism 3 at a second pivot axis 38.

Figure 7:
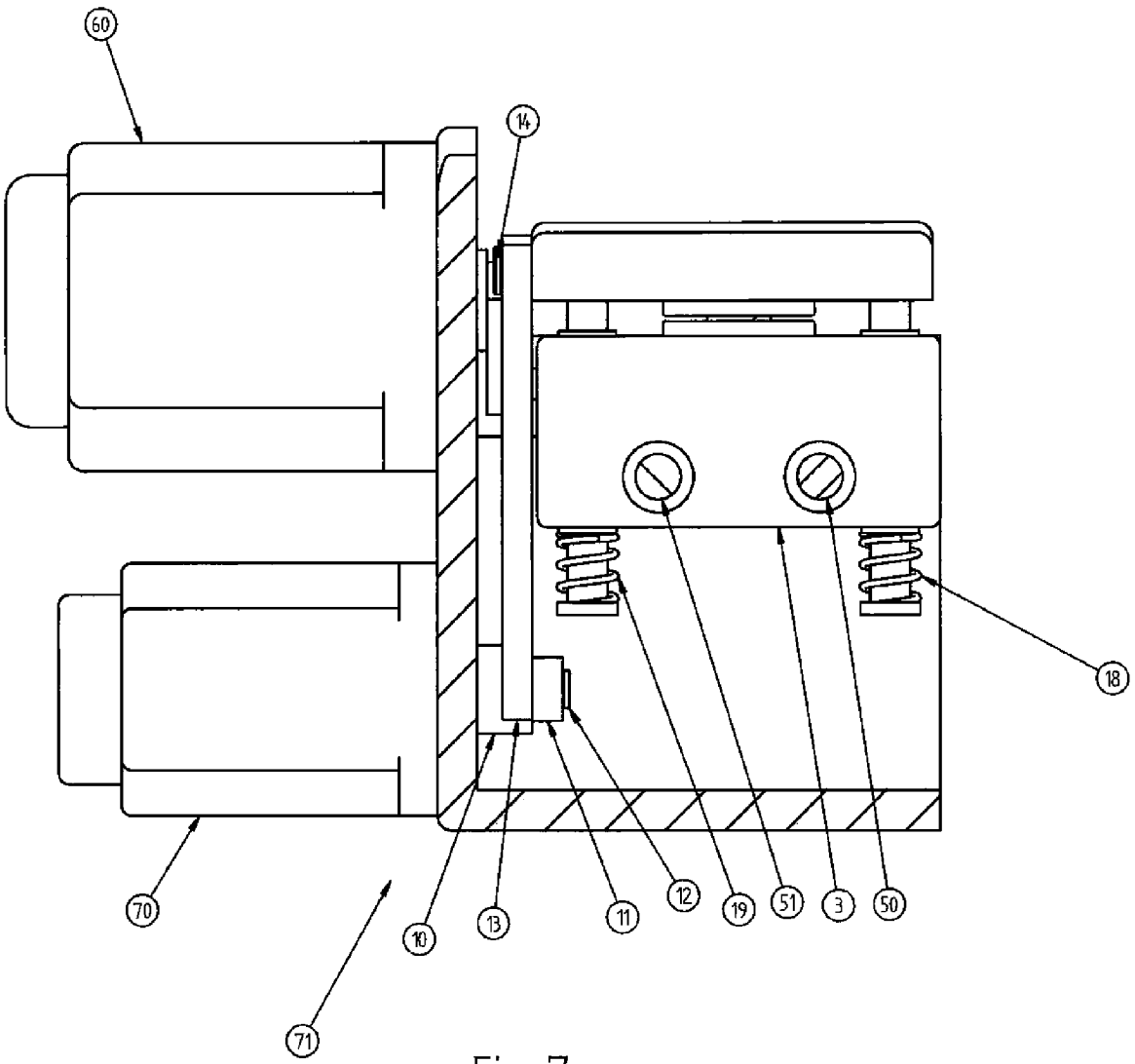
FIG. 7 is a left side cross-sectional view of the apparatus of FIG. 1.

A release actuator 71, depicted generally in FIG. 7, is supported by frame 2 and stationary relative thereto. Release actuator 71 is preferably reversible. Release actuator 71 comprises a reversible motor 70 with output shaft 10 and a drive link or driving member 11 connected to output shaft 10 of motor 70 for rotation therewith. It should be noted that while driving member 11 is shown as a separate component from output shaft 10, driving member 11 could be constructed as an integral part of output shaft 10, such as an eccentric feature of output shaft 10.

Reversible motor 70 is preferably a brushless permanent magnet electric servo motor controlled by a programmable controller 92. Alternatively, reversible motor 70 is an electric stepper motor, a hydraulic motor, or a rotary pneumatic actuator. Programmable controller 92, depicted generally in the drawings is of conventional design well known in the art. Programmable controller 92 is connected with a wire 94 in a particular sense to motor 70 and in a more general sense to release actuator 71.

A release connecting link 13 (FIG. 2) with a first end is pivotally connected at the first end by connecting pin 12 to driving member 11 of release actuator 71 at a first pivot axis 16. A second end of release connecting link 13 is pivotally connected by connecting pin 14 to second gripping member 15 of the first gripper mechanism 3 at a second pivot axis 17. The arrangement of the release connecting link 13 and second pivot axis 17 is such that the second pivot axis 17 is arranged generally perpendicular to the direction of movement of the second gripping member 15 of the first gripper mechanism 3 relative to the first gripping member 30 of the first gripper mechanism 3 and is further arranged generally perpendicular to the first direction of workpiece feeding. As such, the second pivot axis 17 of the first gripper mechanism 3 is movable in the direction of workpiece feeding and in the direction opposite to the direction of workpiece feeding.

Figure 8:
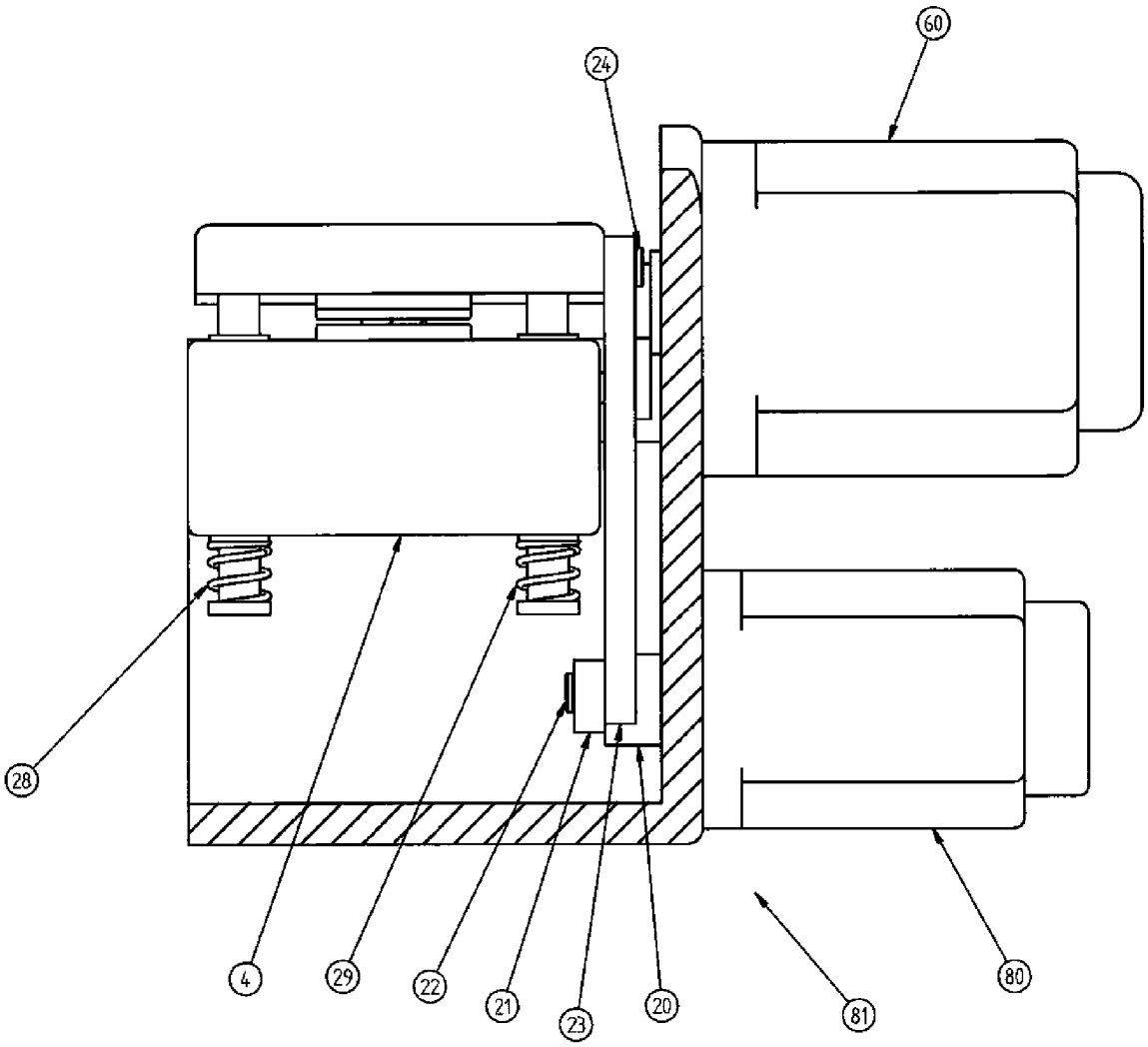
FIG. 8 is a right side cross-sectional view of the apparatus of FIG. 1.

A release actuator 81, depicted generally in FIG. 8, is supported by frame 2 and stationary relative thereto. Release actuator 81 is preferably reversible. Release actuator 81 comprises a reversible motor 80 with output shaft 20 and a drive link or driving member 21 connected to output shaft 20 of motor 80 for rotation therewith. It should be noted that while driving member 21 is shown as a separate component from output shaft 20, driving member 21 could be constructed as an integral part of output shaft 20, such as an eccentric feature of output shaft 10.

Reversible motor 80 is preferably a brushless permanent magnet electric servo motor controlled by a programmable controller 93. Alternatively, reversible motor 80 is an electric stepper motor, a hydraulic motor, or a rotary pneumatic actuator. Programmable controller 93, depicted generally in the drawings is of conventional design well known in the art. Programmable controller 93 is connected with a wire 96 in a particular sense to motor 80 and in a more general sense to release actuator 81.

A release connecting link 23 with a first end is pivotally connected at the first end by connecting pin 22 to driving member 21 of release actuator 81 at a first pivot axis 26 and at a second end by connecting pin 24 to second gripping member 25 at a second pivot axis 27.

In operation, release actuator 71 cooperates with springs 18 and 19 to move second gripping member 15 towards first gripping member 30 for gripping workpiece 100. Alternatively, in the absence of springs 18 and 19, release actuator 71 moves second gripping member 15 towards first gripping member 30 for gripping workpiece 100. In particular, output shaft 10 of reversible motor 70 is rotated to move driving member 11, connecting pins 12 and 14, and release connecting link 13 such that second gripping member 15 is moved into contact with workpiece 100 thereby gripping the workpiece 100 between second gripping member 15 and first gripping member 30.

Figure 3:
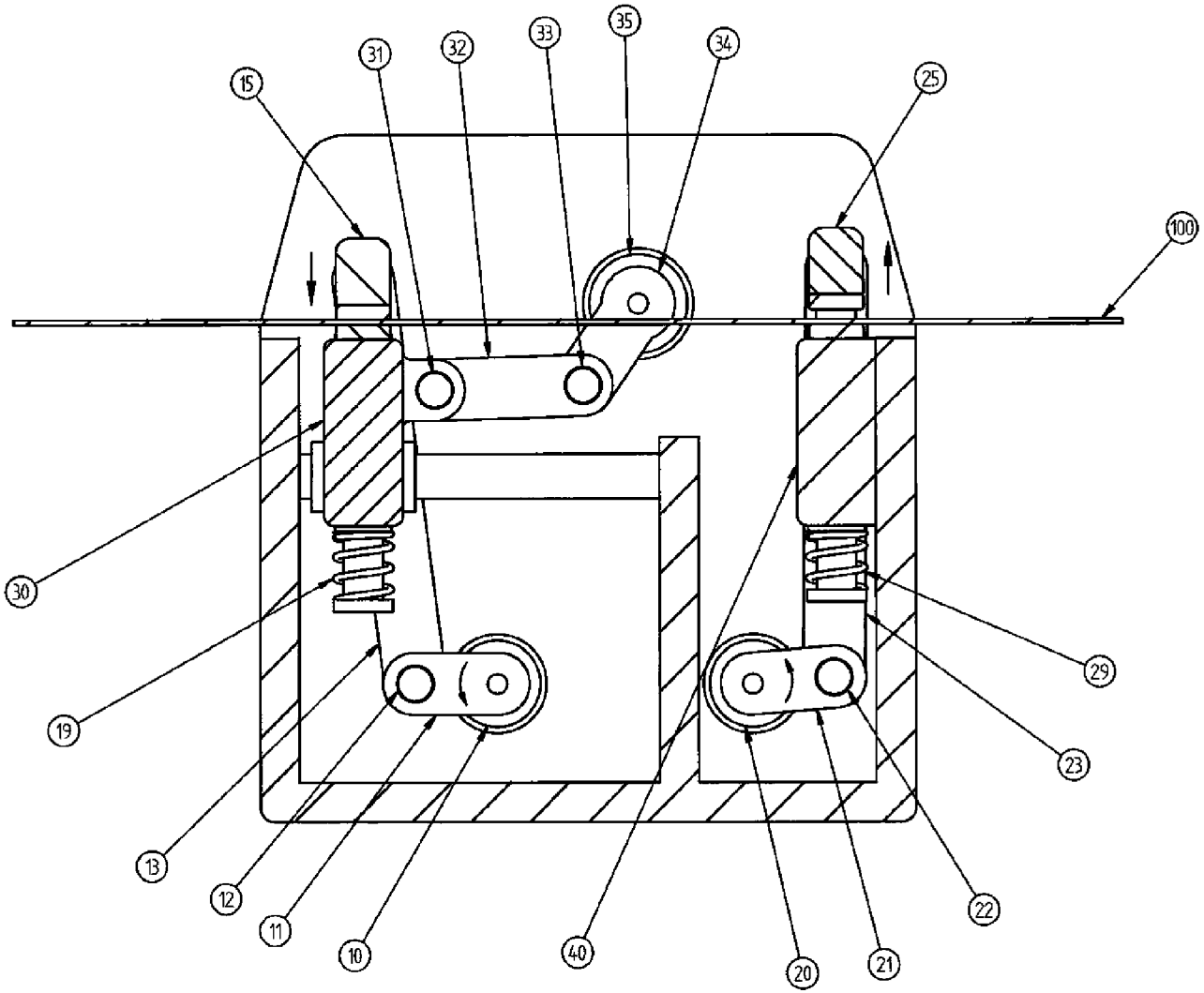
FIG. 3 is a front cross-sectional view of the apparatus of FIG. 1 with the apparatus in one state.

Release actuator 81 moves second gripping member 25 away from first gripping member 40 for releasing a grip on workpiece 100. In particular, output shaft 20 of motor 80 is rotated to move driving member 21, connecting pins 22 and 24, and release connecting link 23 such that second gripping member 25 is moved away from workpiece 100 thereby releasing workpiece 100 from second gripping member 25 and first gripping member 40. FIG. 3 illustrates the feeding apparatus in this state.

Reversible rotary gripper mechanism drive actuator 60 is rotated to move driving member 34, connecting pins 31 and 33, and gripper mechanism drive connecting link 32 such that first gripper mechanism 3 and workpiece 100 is moved in a first direction of workpiece feeding as depicted by an arrow in the drawings. The feeding distance of workpiece 100 is determined by the rotational angle of rotary gripper mechanism drive actuator 60 and driving member 34. As rotary gripper mechanism drive actuator 60 is preferably a brushless permanent magnet electric servo motor commanded by programmable controller 91, the rotation angle of gripper mechanism drive actuator 60 and therefore the feeding distance of workpiece 100 is easily adjusted.

Figure 4:
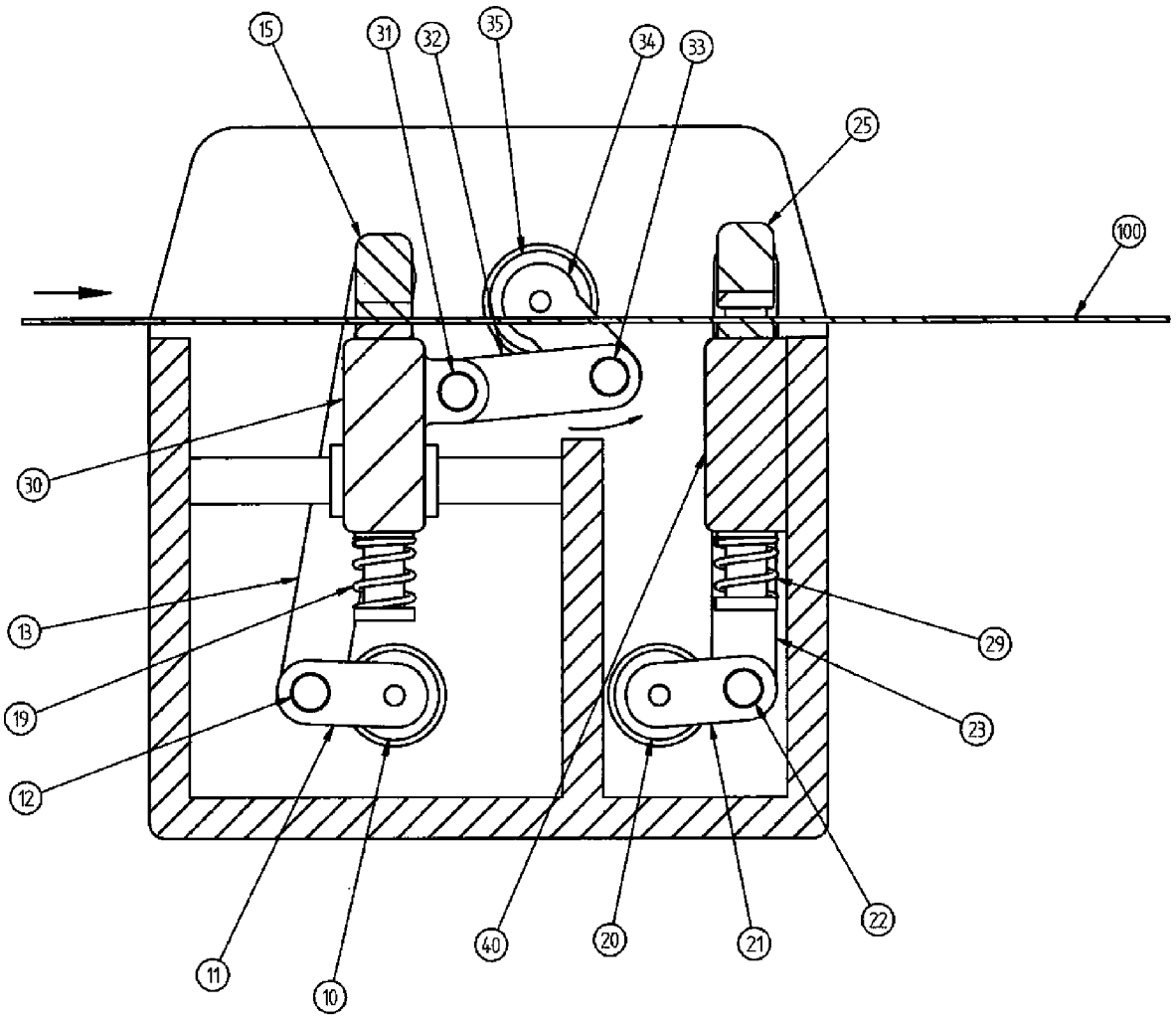
FIG. 4 is a front cross-sectional view of the apparatus of FIG. 1 with the apparatus in another state.

When the required workpiece feeding distance has occurred, reversible rotary gripper mechanism drive actuator 60 is stopped. FIG. 4 illustrates the feeding apparatus in this state.

Release actuator 81 cooperates with springs 28 and 29 to move second gripping member 25 towards first gripping member 40 for a gripping of the workpiece 100. Alternatively, in the absence of springs 28 and 29, release actuator 81 moves second gripping member 25 towards first gripping member 40 for gripping workpiece 100. In particular, output shaft 20 of motor 80 is rotated to move driving member 21, connecting pins 22 and 24, and release connecting link 23 such that second gripping member 25 is moved into contact with workpiece 100 thereby gripping the workpiece 100 between second gripping member 25 and first gripping member 40.

Figure 5:
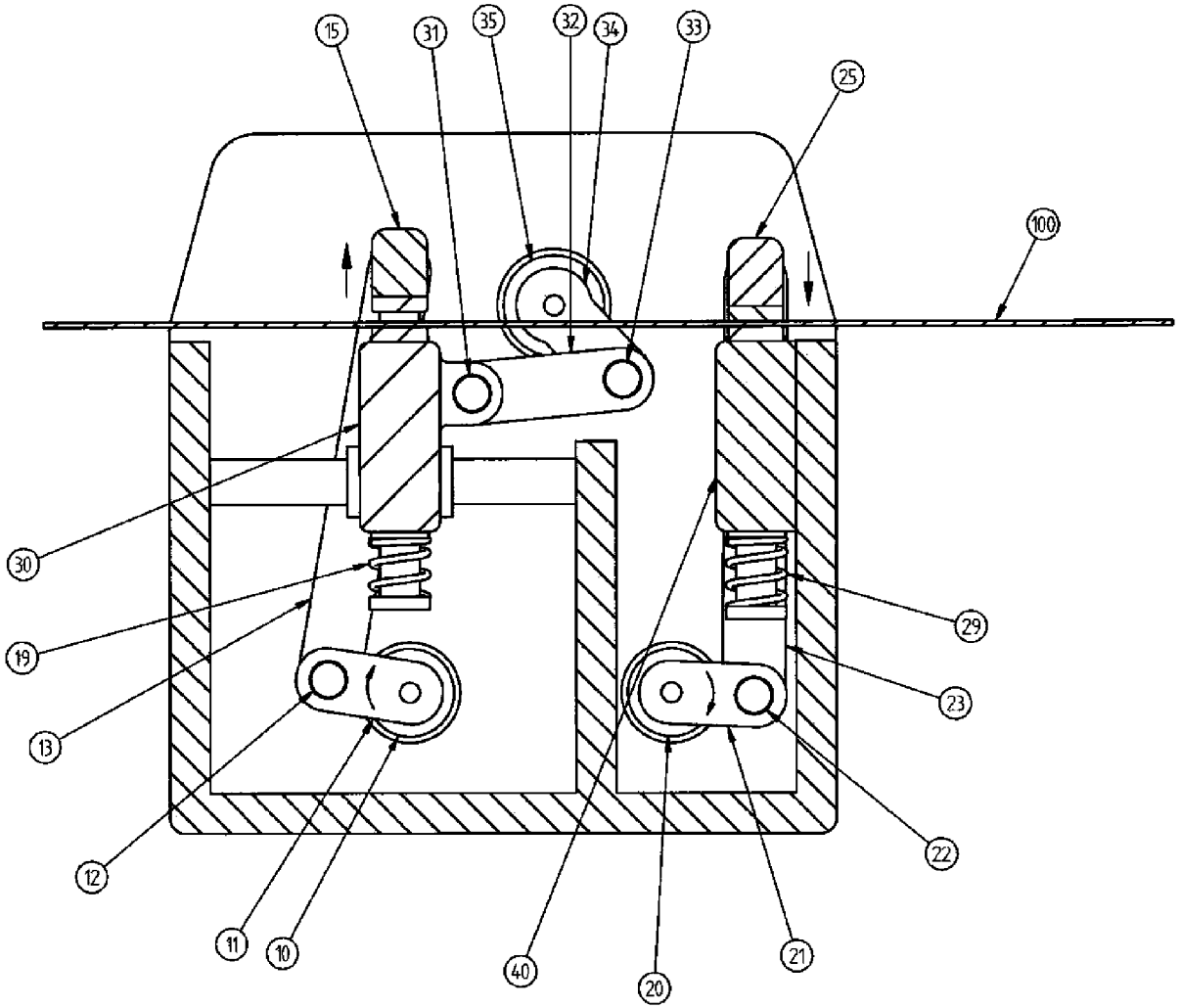
FIG. 5 is a front cross-sectional view of the apparatus of FIG. 1 with the apparatus in still another state.

Release actuator 71 moves second gripping member 15 away from first gripping member 30 for releasing a gripping force on workpiece 100. In particular, output shaft 10 of reversible motor 70 is rotated to move driving member 11, connecting pins 12 and 14, and release connecting link 13 such that second gripping member 15 is moved away from workpiece 100 thereby releasing workpiece 100 from second gripping member 15 and first gripping member 30. That is, by the actuation of release actuator 71, the second gripping member 15 is moved in a direction relative to first gripping member 30 and in a direction generally perpendicular to the first direction of workpiece feeding. FIG. 5 illustrates the feeding apparatus in this state.

Figure 6:
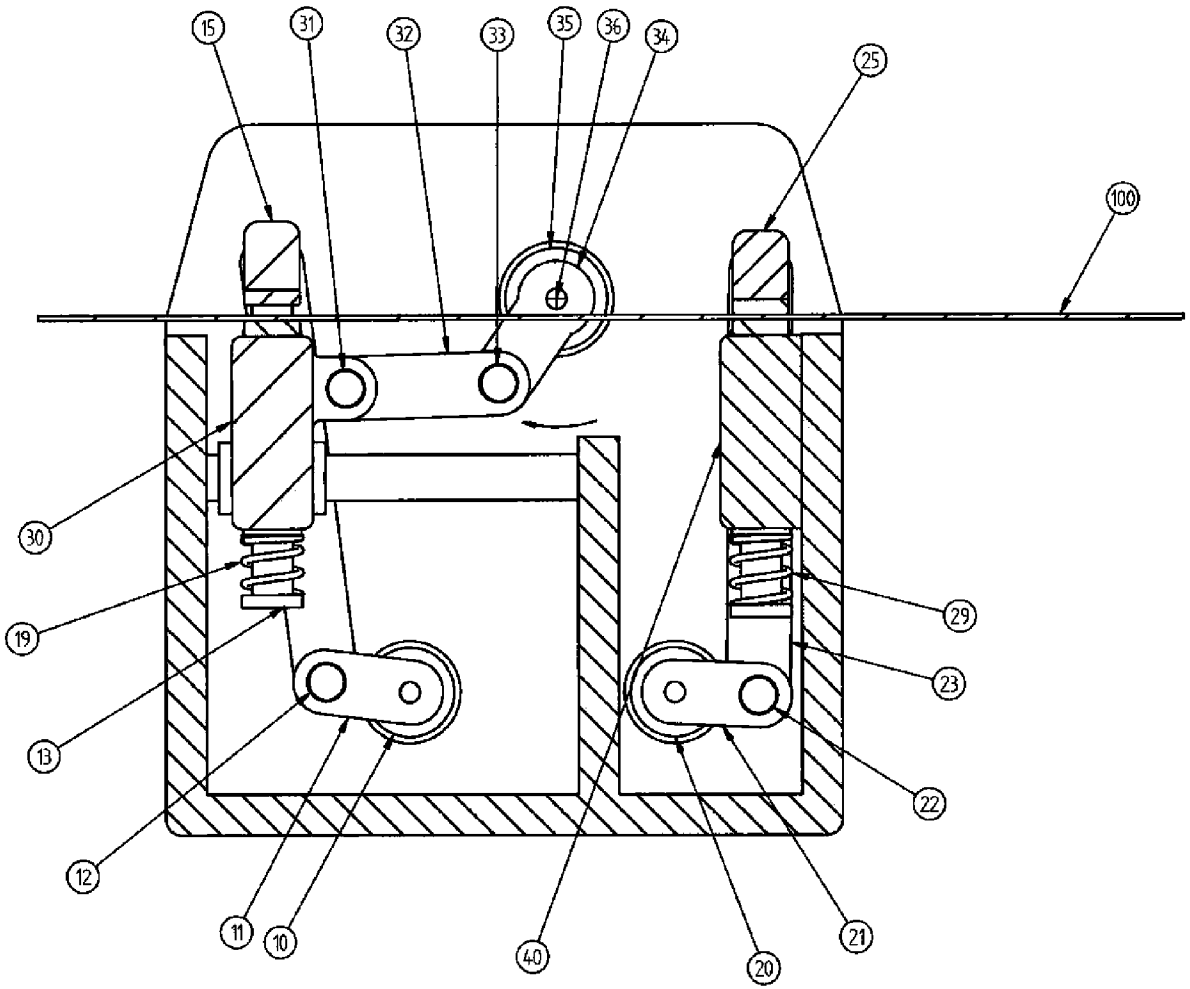
FIG. 6 is a front cross-sectional view of the apparatus of FIG. 1 with the apparatus in still another state.

Reversible rotary gripper mechanism drive actuator 60 is rotated to move driving member 34, connecting pins 31 and 33, and gripper mechanism drive connecting link 32 such that first gripper mechanism 3 is moved in a second direction opposite to the first direction of workpiece feeding. FIG. 6 illustrates the feeding apparatus in this state.

The operation is periodically repeated in synchronization with the stamping machine or the like.

It will be understood by one skilled in the art, that at any time during the period of operation when first gripper mechanism 3 is stopped or moving in the second direction opposite to the first direction of workpiece feeding, release actuator 81 may be used to release the workpiece from second gripper mechanism 4 to allow for a piloting or final positioning operation of a tool or the like in the stamping machine or the like. Alternatively, after the movement of linearly guided gripper mechanism in the first direction of workpiece feeding actuator 80 may be operated in a manner to open second gripping member 25 to release workpiece 100 prior to the operation of release actuator 71 and the subsequent closing of second gripping member 15 to allow for the piloting or final positioning operation of a tool or the like in the stamping machine or the like.

It will be further understood by one skilled in the art, that to maintain continued gripping of the workpiece between gripping members 15 and 30 when movable gripper mechanism 3 is moving in the first direction of workpiece feeding, release actuator 71 will move. The movement of release actuator 71 is such that release connecting link 13, connecting pin 12, connecting pin 14 and therefore pivot axis 17 is moved such that the distance between second gripping member 15 and first gripping member 30 is constant. Programmable controller 92 is configured for this function.

It will be further understood by one skilled in the art, that programmable controller 92 may be configured to control release actuator 71 in a similar manner to move pivot axis 17 such that the opening distance between first and second gripping members 30 and 15 respectively remains constant while first gripper mechanism 3 is moving the second direction opposite to the first direction of workpiece feeding.

It will be further understood by one skilled in the art, that the gripping force exerted by gripping members 15 onto workpiece 100 may be determined by a force produced by release actuator 71 and controlled by programmable controller 92.

It will be further understood by one skilled in the art, that programmable controller 92 and release actuator 71 may be used to determine the distance between gripping member 15 and gripping member 30 thereby providing a gap between the workpiece 100 and gripping member 15 during the times when first gripper mechanism 3 is stopped or moving in a second direction opposite to the first direction. The distance between the gripping members and therefore the gap between workpiece 100 and gripping member 15 may be specifically optimized for different thicknesses of workpiece 100.

A second embodiment in accordance with the present invention will be described below with reference to the accompanying drawings. FIGS. 10-18 show a structure and operation of a feeding apparatus with an embodiment of the present invention. The described embodiment of the feeding apparatus feeds a workpiece such as metal sheets or wire, or the like to a press machine, stamping machine or the like. It should be understood that the feeding apparatus may be used with other materials or in combination with other types of machines requiring the intermittent feeding of workpiece.

Figure 10:
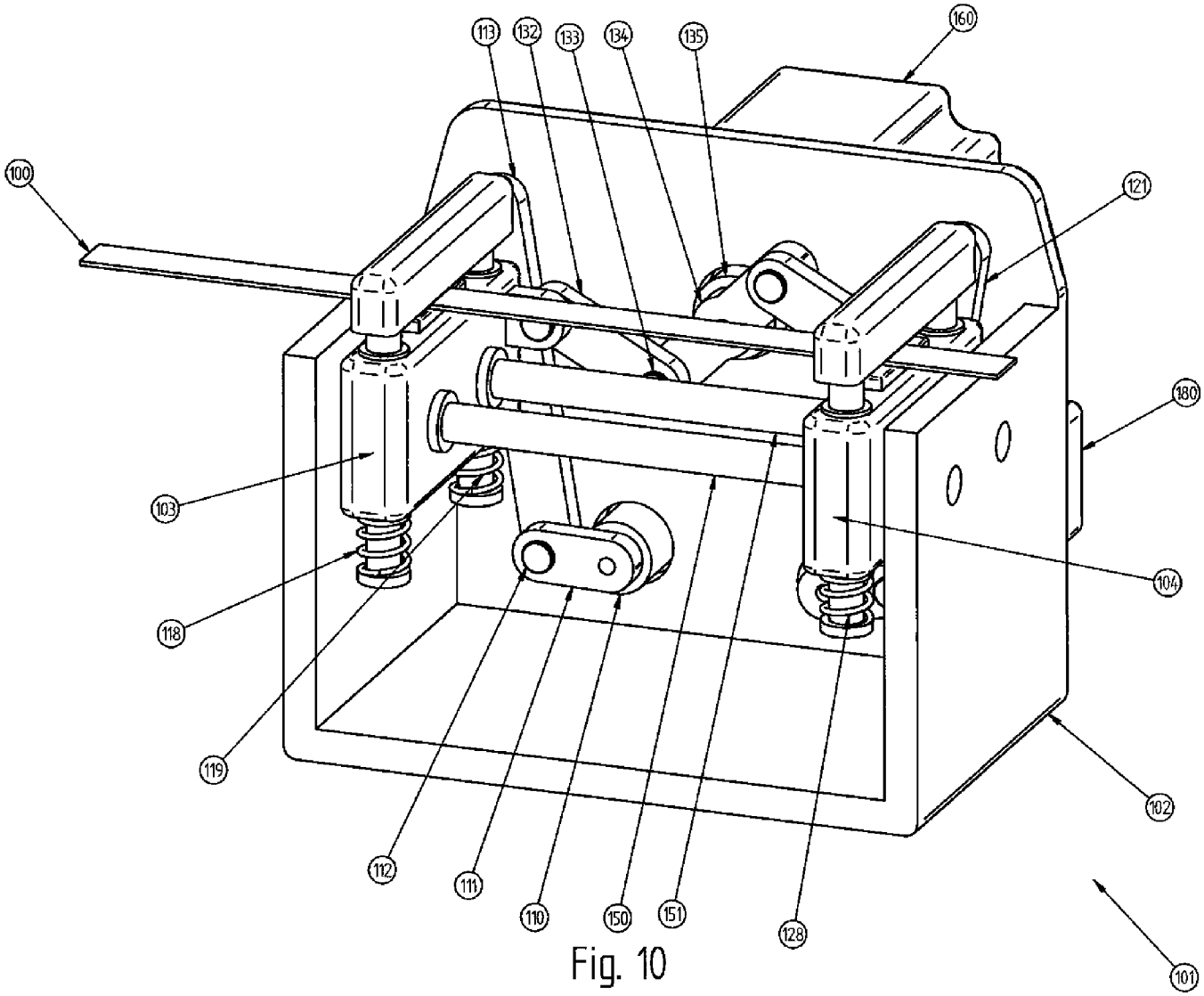
FIG. 10 is a front perspective view of a gripper type material feeding apparatus according to a second embodiment of the invention.
Figure 11:
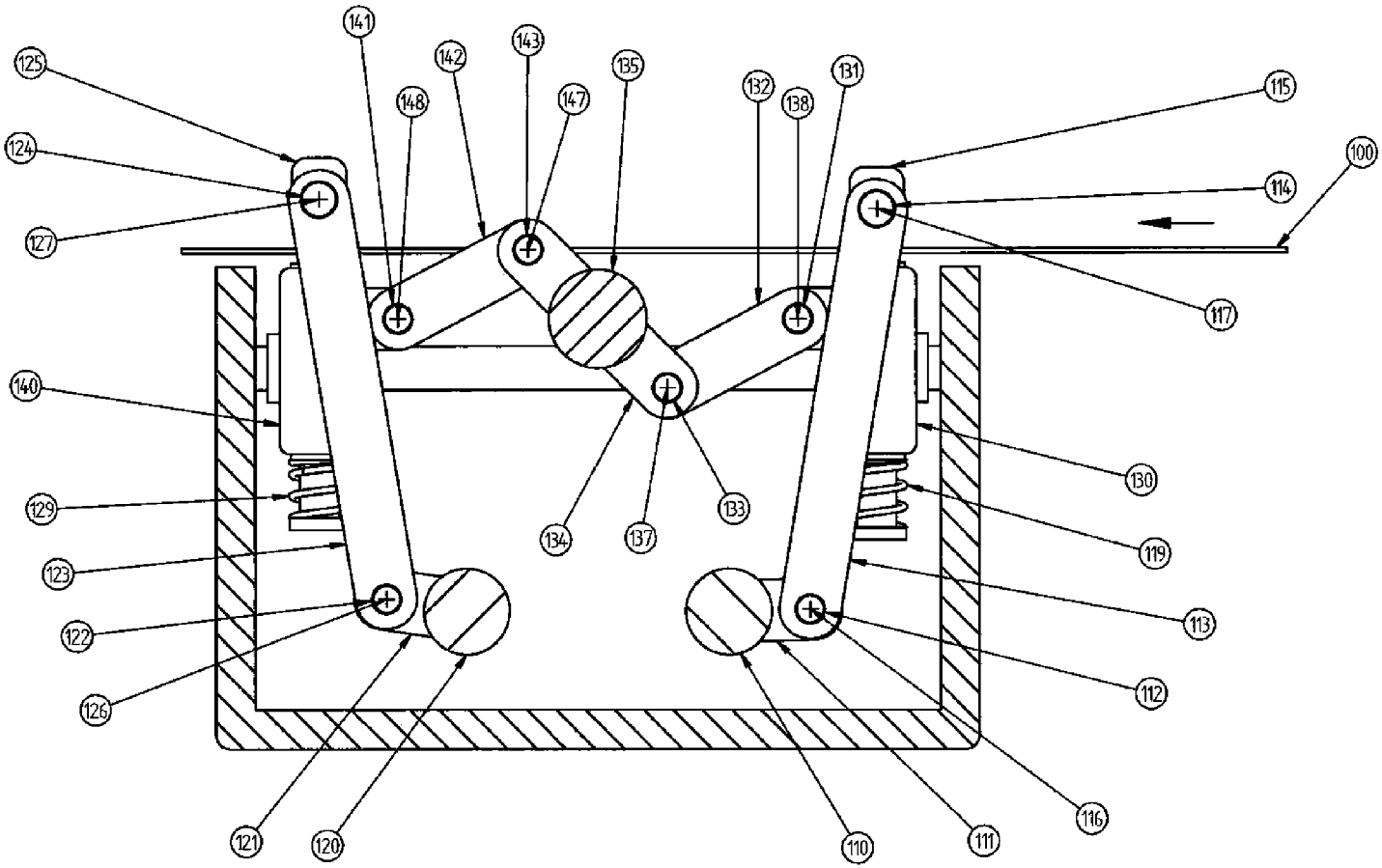
FIG. 11 is a rear cross-sectional view of the apparatus of FIG. 10.

A feeding apparatus 101, depicted generally in FIG. 10, is provided with a frame 102.

A workpiece 100 is illustrated and a first direction of workpiece feeding is depicted with a direction arrow.

A first gripper mechanism 103 is supported by and configured for linear movement along linear guides 150 and 151. Linear guides 150 and 151 are supported by frame 102 and stationary relative thereto. In the illustrated embodiment, linear guides 150 and 151 are parallel cylindrical rods. Linear guides 150 and 151 are arranged parallel to the direction of workpiece feeding. First gripper mechanism 103 is therefore linearly guided and movable in a first direction of workpiece feeding and in a direction opposite to the first direction of workpiece feeding.

First gripper mechanism 103 comprises a first gripping member 130 and a second gripping member 115. Second gripping member 115 is movable relative to first gripping member 130. Further, in this embodiment, first gripper mechanism 103 further comprises a first spring 118 and a second spring 119. First and second springs 118 and 119 are arranged for urging second gripping member 115 toward gripping member 130. Alternatively either first spring 118 or second spring 119 or both may be omitted.

A second movable gripper mechanism 104 is supported by and configured for linear movement along the linear guides 150 and 151. Second gripper mechanism 104 comprises a first gripping member 140 and a second gripping member 125. Second gripping member 125 is movable relative to first gripping member 140. Further, in this embodiment, second gripper mechanism 104 further comprises a first spring 128 and a second spring 129. First and second springs 128 and 129 are arranged for urging second gripping member 125 toward gripping member 140. Alternatively either first spring 128 or second spring 129 or both may be omitted.

Figure 18:
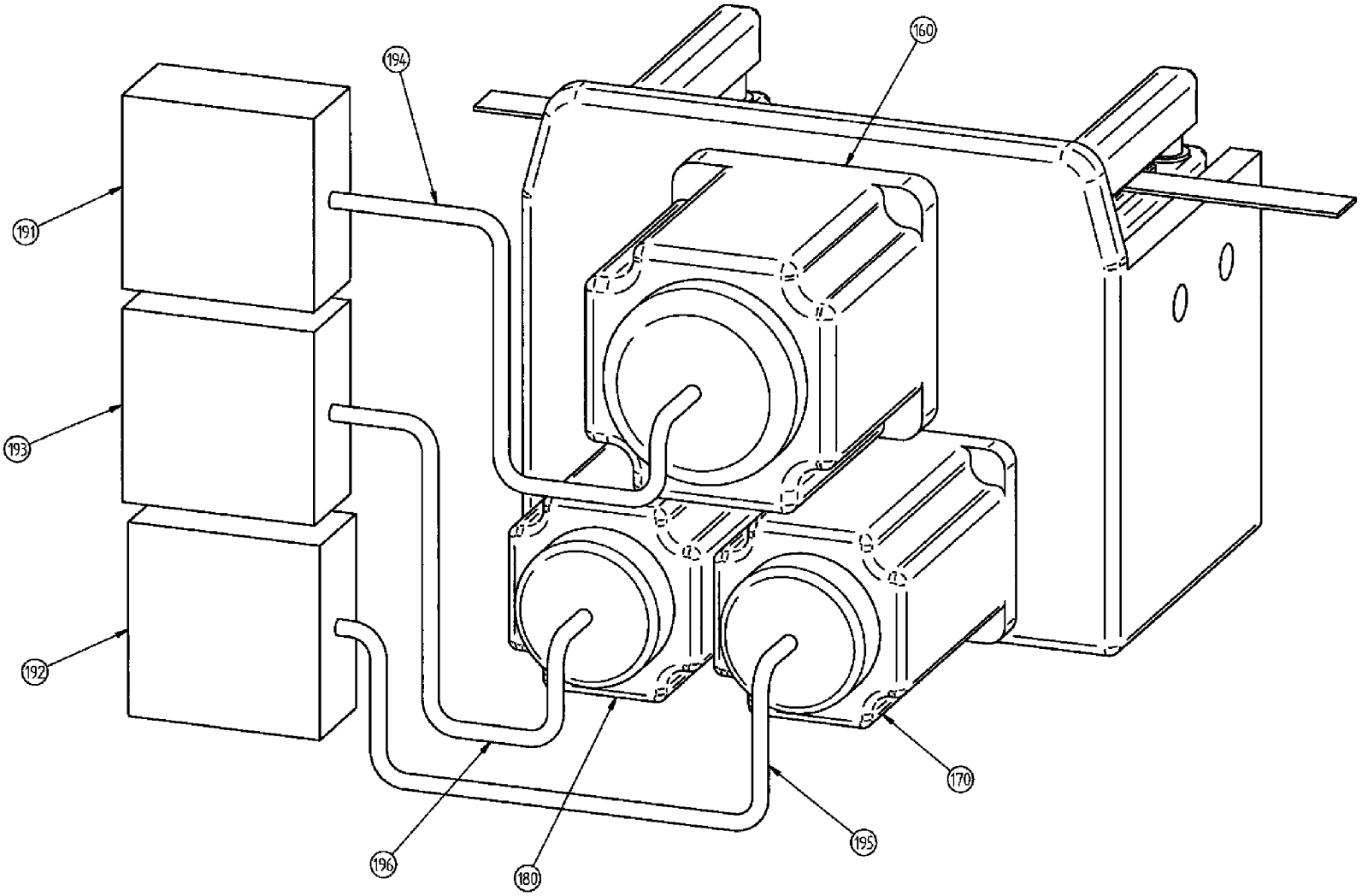
FIG. 18 is a rear perspective view of the apparatus of FIG. 10.

A reversible rotary gripper mechanism drive actuator 160 is supported by frame 102 and stationary relative thereto. Reversible rotary gripper mechanism drive actuator 160 is preferably a brushless permanent magnet electric servo motor. Alternatively, reversible rotary gripper mechanism drive actuator 160 may be a stepper motor, a hydraulic motor, a rotary pneumatic actuator, or any reversible rotary actuator that may be adjustable in angle of rotation. Reversible rotary gripper mechanism drive actuator 160 is controlled by a programmable controller 191 (FIG. 18). Programmable controller 91 is configured for adjusting the rotation angle of the gripper mechanism drive actuator 160. The rotation angle of reversible rotary gripper mechanism drive actuator 160 is therewith controlled and thereby adjustable. That is, gripper mechanism drive actuator 160 is an angularly adjustable rotary actuator. Programmable controller 191, depicted generally in the drawings is of conventional design well known in the art. Programmable controller 91 is connected to actuator 161 with a wire 194

A drive link or driving member 134 is connected to output shaft 135 of reversible rotary gripper mechanism drive actuator 160 for rotation therewith. Driving member 134 being connected to output shaft 135 for rotation therewith rotates about a rotation axis 136 of output shaft 135. It should be noted that while driving member 134 is shown as a separate component from output shaft 135 of reversible rotary gripper mechanism drive actuator 160, driving member 134 could be constructed as an integral part of output shaft 135, such as an eccentric feature of output shaft 135.

A first gripper mechanism drive connecting link 132 is pivotally connected at a first end by connecting pin 133 to a first end of driving member 134 at a first pivot axis 137 and at a second end by connecting pin 131 to movable gripper mechanism 103 at a second pivot axis 138.

A second gripper mechanism drive connecting link 142 is pivotally connected at a first end by connecting pin 143 to a second end of driving member 134 at a first pivot axis 147 and at a second end by connecting pin 141 to movable gripper mechanism 104 at a second pivot axis 148.

In operation the distance between rotational axis 136 and first pivot axis 137 is constant. Furthermore, in operation the distance between rotational axis 136 and third pivot axis 147 is constant. That is, driving member 134 is a fixed length driving member.

Also in operation, the rotation axis 136 of output shaft 135 and due to the connection of driving member 134 thereto, is located at the midpoint between the first pivot axis 137 and third pivot axis 147.

Still also in operation, gripper mechanism drive connecting link 142 and gripper mechanism drive connecting link 132 are equal in length.

Figure 16:
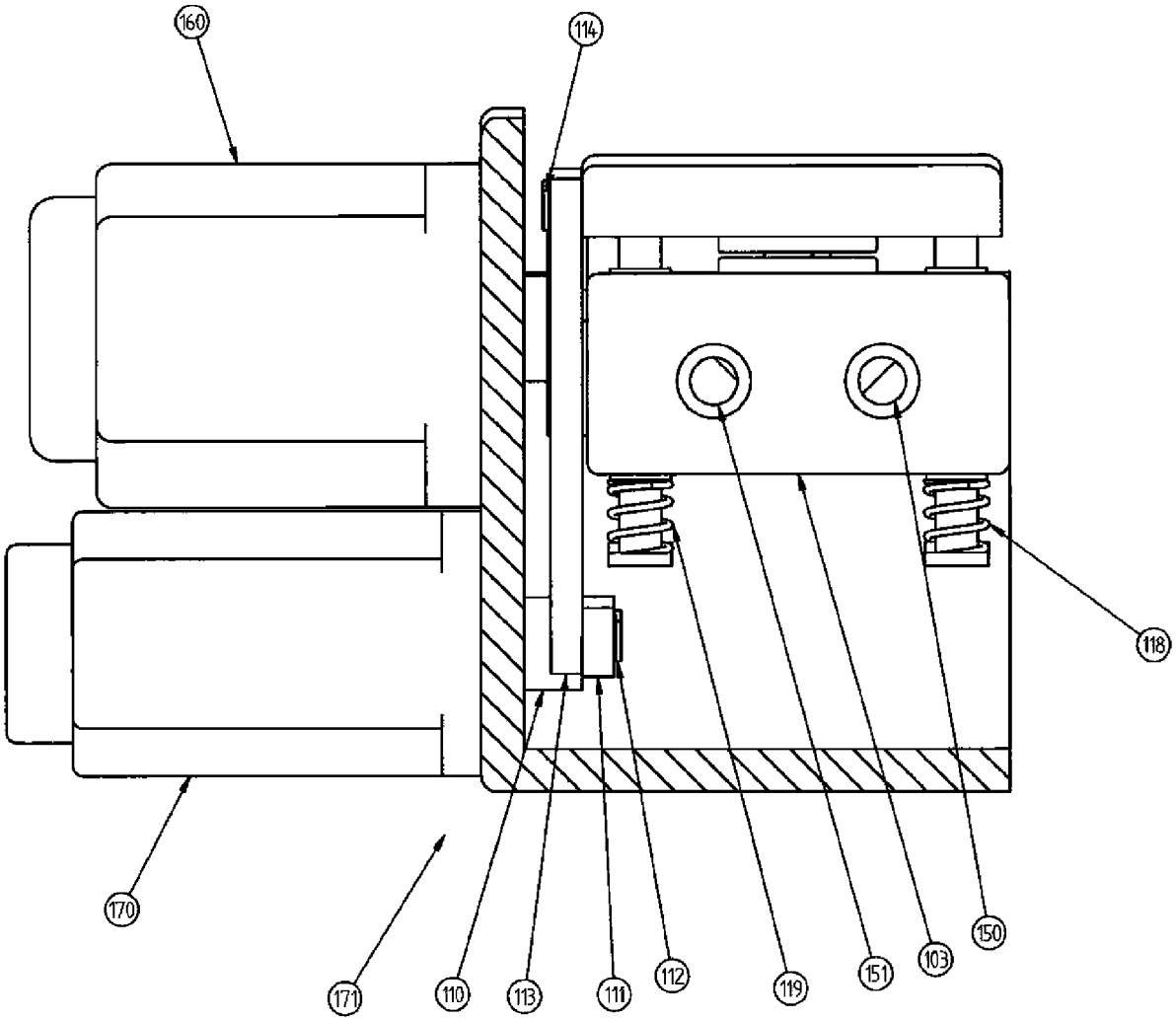
FIG. 16 is a left side cross-sectional view of the apparatus of FIG. 10.

An release actuator 171, depicted generally in FIG. 16, is supported by frame 102 and stationary relative thereto. Release actuator 171 is preferably reversible. Release actuator 171 comprises a reversible motor 170 with output shaft 110 and a driving link or driving member 111 connected to output shaft 110 of motor 170 for rotation therewith. It should be noted that while driving member 111 is shown as a separate component from output shaft 110, driving member 111 could be constructed as an integral part of output shaft 110, such as an eccentric feature of output shaft 110.

Reversible motor 170 is preferably a brushless permanent magnet electric servo motor controlled by a programmable controller 192. Alternatively, reversible motor 170 is an electric stepper motor, a hydraulic motor, or a rotary pneumatic actuator. Programmable controller 192, depicted generally in the drawings is of conventional design well known in the art. Programmable controller 192 is connected with a wire 194 in a particular sense to motor 170 and in a more general sense to release actuator 171.

A release connecting link 113 (FIG. 11) is pivotally connected at a first end by connecting pin 112 to driving member 111 at a first pivot axis 116 and at a second end by connecting pin 114 to second gripping member 115 at a second pivot axis 117. The arrangement of the release connecting link 113 and second pivot axis 117 is such that the second pivot axis 117 is arranged generally perpendicular to the direction of movement of the second gripping member 115 of the first gripper mechanism 103 relative to the first gripping member 130 of the first gripper mechanism 103 and is further arranged generally perpendicular to the first direction of workpiece feeding. As such, the second pivot axis 117 of the first gripper mechanism 103 is movable in the direction of workpiece feeding and in the direction opposite to the direction of workpiece feeding.

Figure 17:
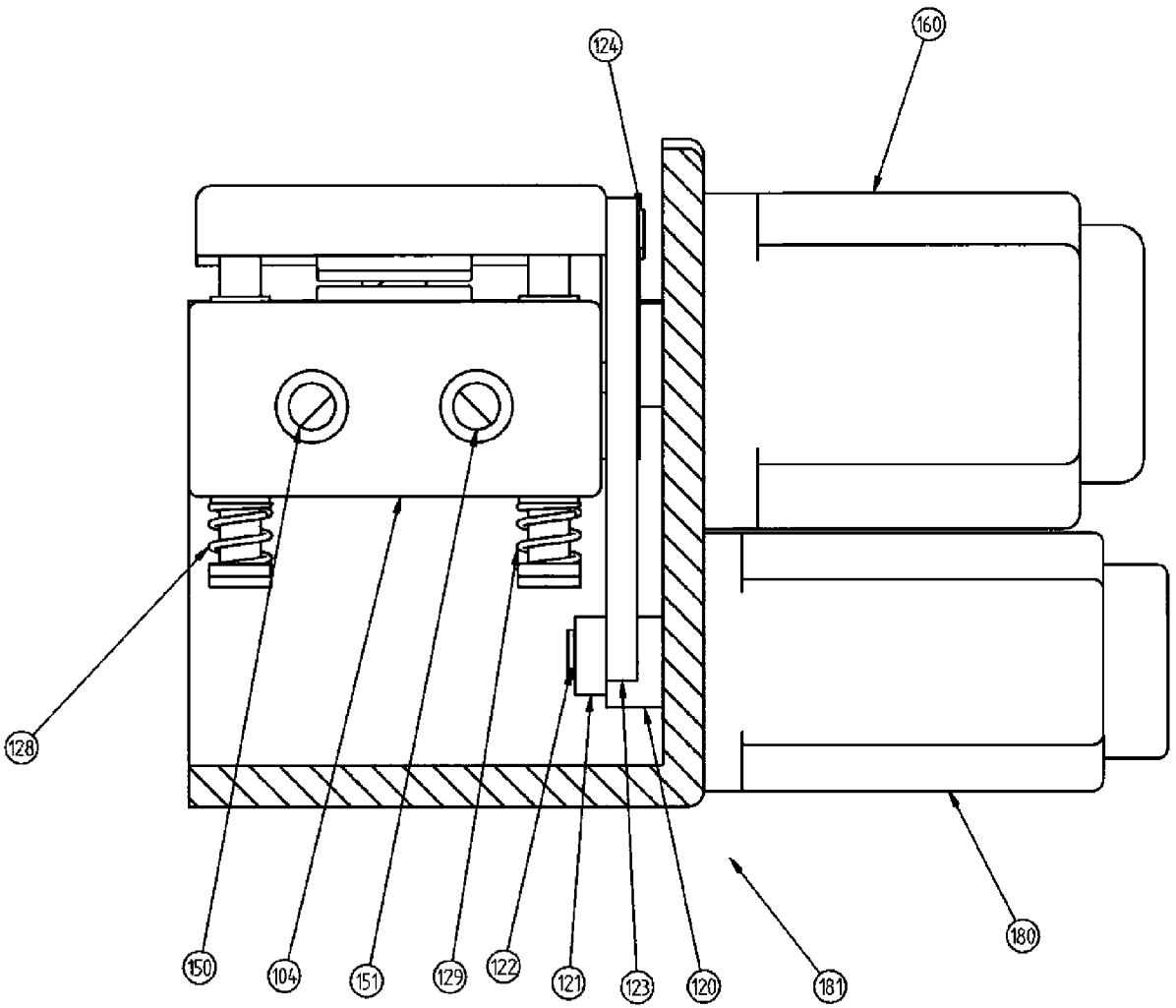
FIG. 17 is a right side cross-sectional view of the apparatus of FIG. 10.

An release actuator 181, depicted generally in FIG. 17, is supported by frame 102 and stationary relative thereto. Release actuator 181 is preferably reversible. Release actuator 181 comprises a reversible motor 180 with output shaft 120 and a drive link or driving member 121 connected to output shaft 120 of motor 180 for rotation therewith. It should be noted that while driving member 121 is shown as a separate component from output shaft 120, driving member 121 could be constructed as an integral part of output shaft 120, such as an eccentric feature of output shaft 120.

Reversible motor 180 is preferably a brushless permanent magnet electric servo motor controlled by a programmable controller 193. Alternatively, reversible motor 180 is an electric stepper motor, a hydraulic motor, or a rotary pneumatic actuator. Programmable controller 193, depicted generally in the drawings is of conventional design well known in the art. Programmable controller 193 is connected with a wire 196 in a particular sense to motor 180 and in a more general sense to release actuator 181.

A release connecting link 123 is pivotally connected at a first end by connecting pin 122 to driving member 121 at a first pivot axis 126 and at a second end by connecting pin 124 to second gripping member 125 at a second pivot axis 127. The arrangement of the release connecting link 123 and second pivot axis 127 is such that the second pivot axis 127 is arranged generally perpendicular to the direction of movement of the second gripping member 125 of the first gripper mechanism 104 relative to the first gripping member 140 of the first gripper mechanism 104 and is further arranged generally perpendicular to the first direction of workpiece feeding. As such, the second pivot axis 127 of the first gripper mechanism 104 is movable in the direction of workpiece feeding and in the direction opposite to the direction of workpiece feeding.

In operation, release actuator 171 cooperates with springs 118 and 119 to move second gripping member 115 towards first gripping member 130 for gripping workpiece 100. Alternatively, in the absence of springs 118 and 119, release actuator 171 moves second gripping member 115 towards first gripping member 130 for gripping workpiece 100. In particular, output shaft 110 of reversible motor 170 is rotated to move driving member 111, connecting pins 112 and 114, and release connecting link 113 such that second gripping member 115 is moved into contact with workpiece 100 thereby gripping the workpiece 100 between second gripping member 115 and first gripping member 130.

Figure 12:
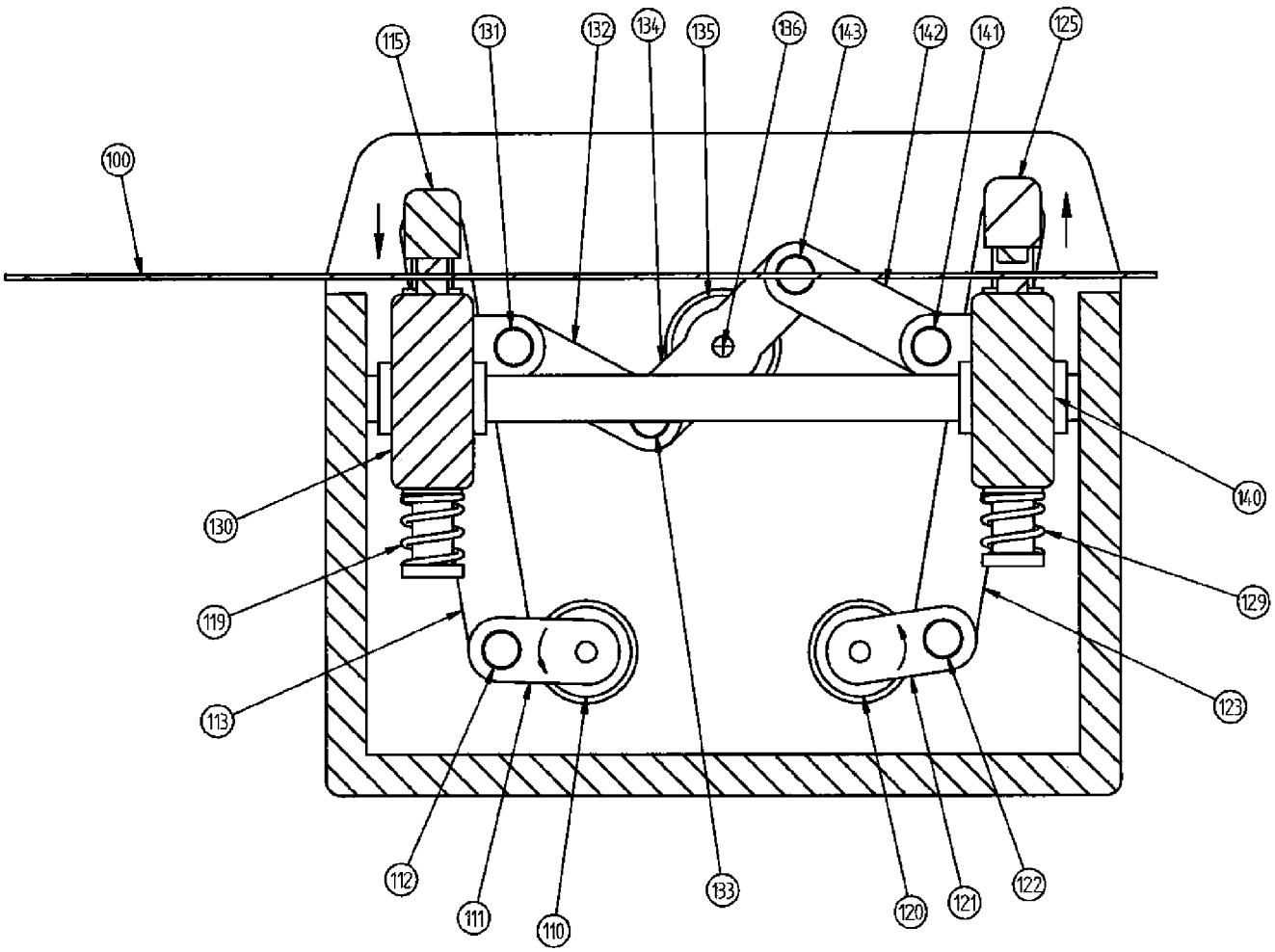
FIG. 12 is a front cross-sectional view of the apparatus of FIG. 10 with the apparatus in one state.

Release actuator 181 moves second gripping member 125 away from first gripping member 140 for releasing a grip on workpiece 100. In particular, output shaft 120 of motor 180 is rotated to move driving member 121, connecting pins 122 and 124, and release connecting link 123 such that second gripping member 125 is moved away from workpiece 100 thereby releasing workpiece 100 from second gripping member 125 and first gripping member 140. FIG. 12 illustrates the feeding apparatus in this state.

Reversible rotary gripper mechanism drive actuator 160 is rotated to move driving member 134, connecting pins 131 and 133, and gripper mechanism drive connecting link 132 such that first gripper mechanism 103 and workpiece 100 is moved in a first direction of workpiece feeding as depicted by an arrow in the drawings. The feeding distance of workpiece 100 is determined by the rotational angle of rotary gripper mechanism drive actuator 160 and driving member 134. As rotary gripper mechanism drive actuator 160 is preferably a brushless permanent magnet electric servo motor controlled by programmable controller 191, the rotation angle of rotary gripper mechanism drive actuator 160 and therefore the feeding distance of workpiece 100 is easily adjusted.

At the same time due to the interconnected nature of the components, connecting pins 141 and 143, and gripper mechanism drive connecting link 142 is moved by driving member 134 such that the second gripper mechanism 104 is moved in a second direction opposite to the first direction of workpiece feeding.

Figure 13:
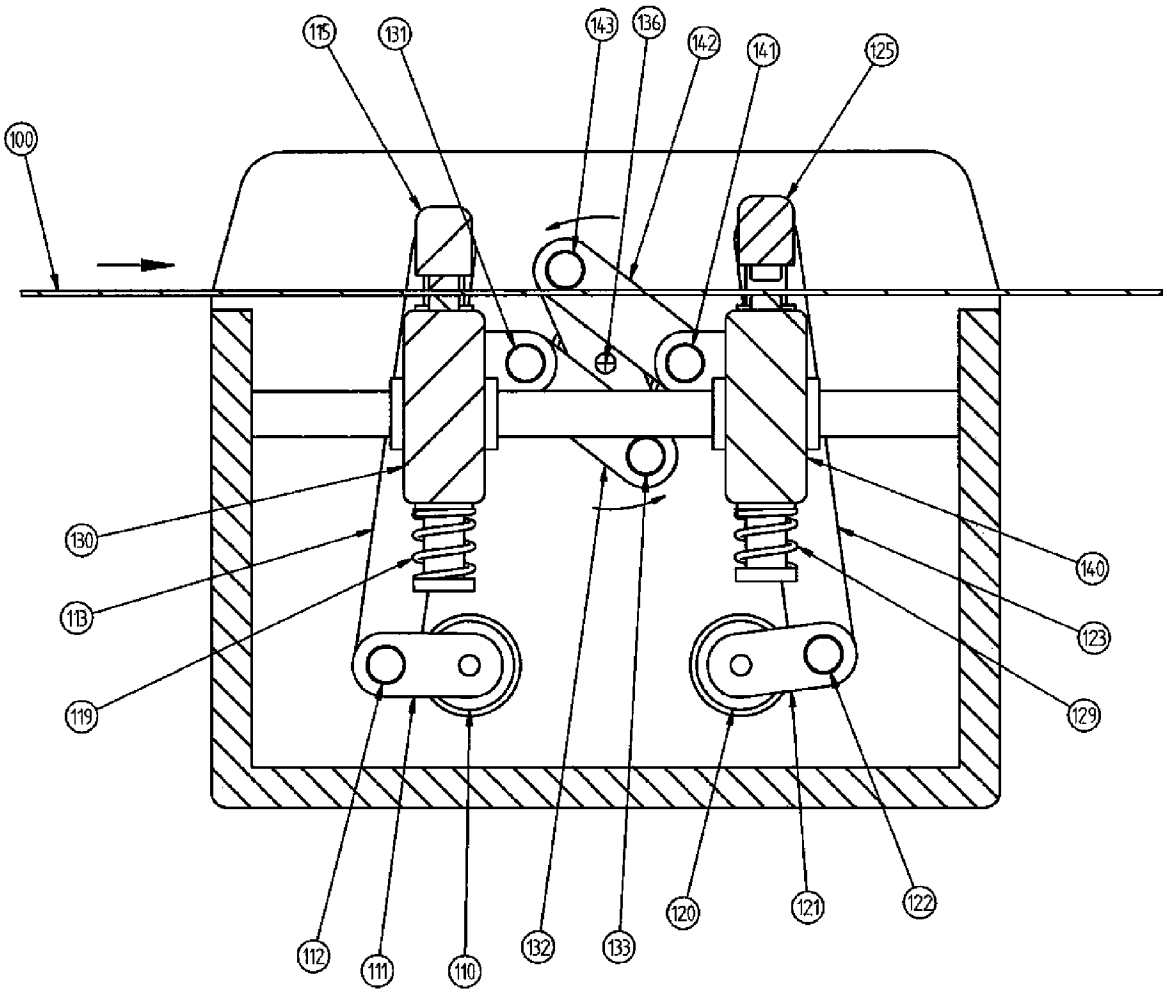
FIG. 13 is a front cross-sectional view of the apparatus of FIG. 10 with the apparatus in another state.

When the required workpiece feeding distance has occurred, reversible rotary gripper mechanism drive actuator 160 is stopped. FIG. 13 illustrates the feeding apparatus in this state Release actuator 181 cooperates with springs 128 and 129 to move second gripping member 125 towards first gripping member 140 for a gripping of the workpiece 100. Alternatively, in the absence of springs 128 and 129, release actuator 181 moves second gripping member 125 towards first gripping member 140 for gripping workpiece 100. In particular, output shaft 120 of motor 180 is rotated to move driving member 121, connecting pins 122 and 124, and release connecting link 123 such that second gripping member 125 is moved into contact with workpiece 100 thereby gripping the workpiece 100 between second gripping member 124 and first gripping member 140.

Figure 14:
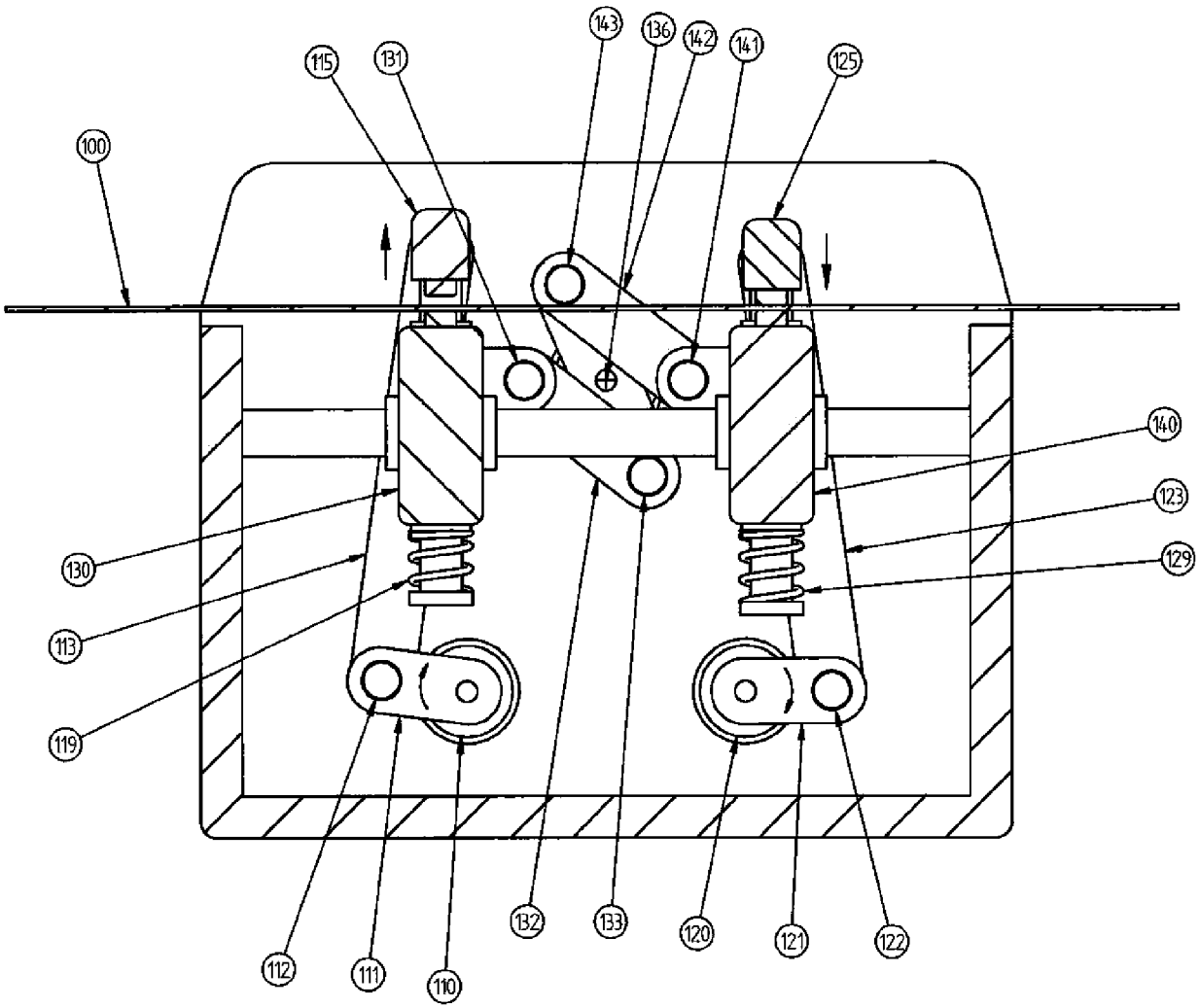
FIG. 14 is a front cross-sectional view of the apparatus of FIG. 10 with the apparatus in still another state.

Release actuator 171 moves second gripping member 115 away from first gripping member 130 for releasing a gripping force on workpiece 100. In particular, output shaft 110 of motor 170 is rotated to move driving member 111, connecting pins 112 and 114, and release connecting link 113 such that second gripping member 115 is moved away from workpiece 100 thereby releasing workpiece 100 from second gripping member 115 and first gripping member 130. That is, by actuation of release actuator 171, the second gripping member 115 is moved in a direction relative to first gripping member 130 and in a direction generally perpendicular to the first direction of workpiece feeding. FIG. 14 illustrates the feed apparatus in this state.

Reversible rotary gripper mechanism drive actuator 160 is rotated to move driving member 134, connecting pins 141 and 143, and gripper mechanism drive connecting link 142 such that second gripper mechanism 104 is moved in the first feeding direction of workpiece 100. The feeding distance of workpiece 100 is determined by the rotational angle of rotary gripper mechanism drive actuator 160 and driving member 134.

Figure 15:
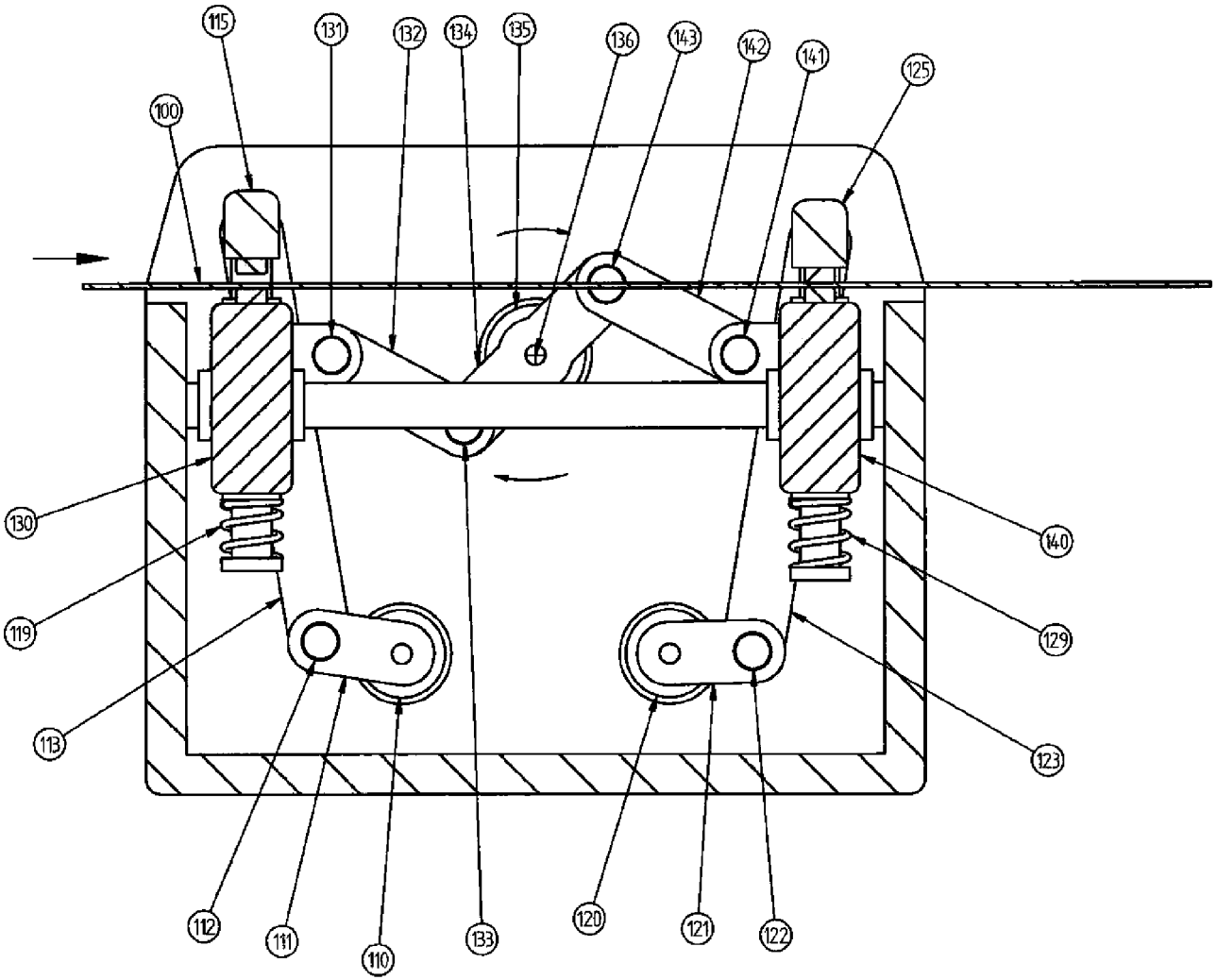
FIG. 15 is a front cross-sectional view of the apparatus of FIG. 10 with the apparatus in still another state.

At the same time due to the interconnected nature of the components, connecting pins 131 and 133, and gripper mechanism drive connecting link 132 is moved by driving member 134 such that first gripper mechanism 103 is moved in a direction opposite to the first feeding direction of workpiece 100. FIG. 15 illustrates the feed apparatus in this state.

The operation is periodically repeated in synchronization with the stamping machine or the like.

It will be understood by one skilled in the art, that at any time during the period of operation when the movable gripper mechanisms 103 and 104 are stopped, actuators 171 and 181 may be used to release the workpiece from both first and second movable gripper mechanisms 103 and 104 to allow for a piloting or final positioning operation of a tool or the like in the stamping machine or the like.

Figure 19:
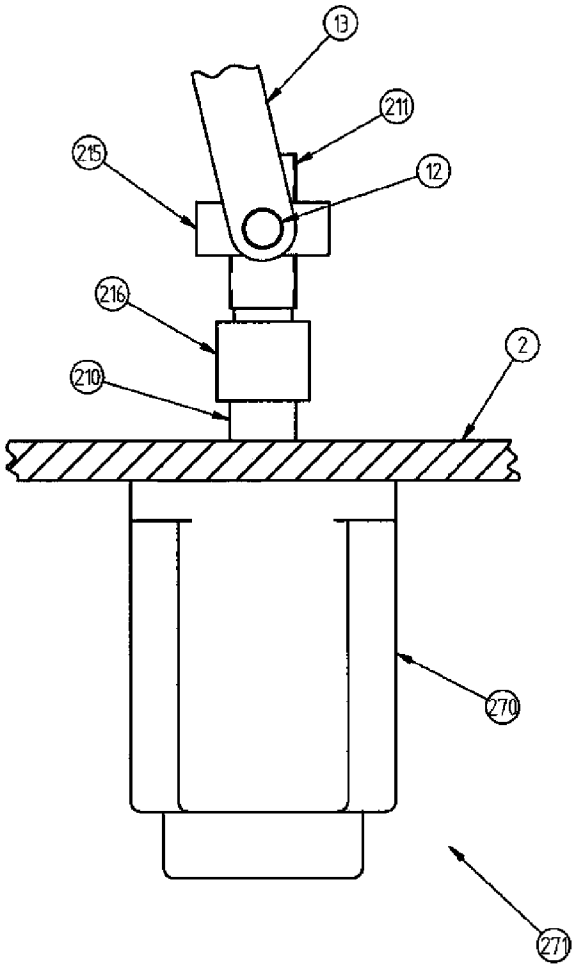
FIG. 19 is a sectioned view of an actuator for use in a material feeding apparatus according to a further embodiment of the invention.
Figure 20:
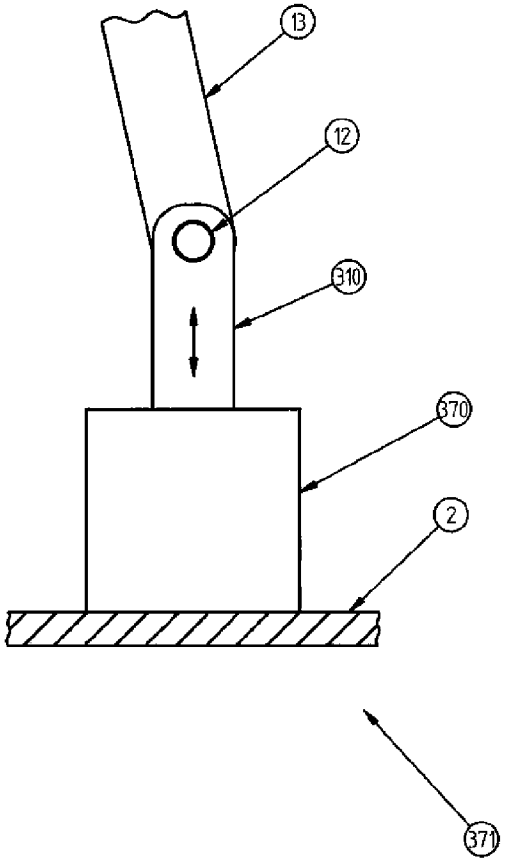
FIG. 20 is a sectioned view of an actuator for use in a material feeding apparatus according to a further embodiment of the invention.

Alternative actuator constructions in accordance with the present invention will be described below with reference to the accompanying drawings. FIGS. 19 and 20 illustrate alternative constructions of the actuators previously designated 71, 81, 171, and 181.

An actuator 271, depicted generally in FIG. 19, is supported by frame 2 and stationary relative thereto. Actuator 271 is preferably reversible. Actuator 271 comprises a reversible motor 270 with output shaft 210 and a threaded rod 211 connected to output shaft 210 of motor 270 with coupling 216 for rotation therewith. It should be noted that while threaded rod 211 is shown as a separate component from output shaft 210, threaded rod 211 could be constructed as an integral part of output shaft 210 and with coupling 216 eliminated.

Reversible motor 270 is preferably a brushless permanent magnet electric servo motor controlled by the programmable controller 92. Alternatively, reversible motor 270 is an electric stepper motor, a hydraulic motor, or a rotary pneumatic actuator.

Actuator 271 further comprises an internally threaded member 215. Threaded rod 211 and internally threaded member 215 cooperated to produce a linear movement of internally threaded member 215 upon rotation of threaded rod 211. The threads of threaded rod 211 and internally threaded member 215 are preferable of a trapezoidal type power thread. Alternatively the threads of threaded rod 211 and internally threaded member 215 could be of standard triangular type. Alternatively threaded rod 211 could be a ball screw and internally threaded member 215 a re-circulating ball nut.

Release connecting link 13 is at the first end pivotally connected by the connecting pin 12 to internally threaded member 215.

An actuator 371, depicted generally in FIG. 20, is supported by frame 2 and stationary relative thereto. Actuator 371 is preferable reversible. Actuator 371 comprises a reversible linear actuator 370 with a thrusting member 310 arranged for linear movement. Reversible linear actuator 370 is preferably a linear electric motor controlled by the programmable controller 92. Alternatively, reversible linear actuator 370 is a linear stepper motor, an electric solenoid, a hydraulic cylinder, a pneumatic cylinder, or any reversible linear actuator that comprises a thrusting member with linear movement.

Release connecting link 13 is at the first end pivotally connected by the connecting pin 12 to linear thrusting member 310.

Alternative actuators 271 and 371 may be operated to provide a substantively equivalent function to that of actuators 71, 81, 171 and 181.

While the illustrated embodiments are shown having upper gripping members being the movable gripping member, it should be understood that, alternatively, the lower gripping members could be the movable gripping member.

Further, although the apparatus is described as having an actuator and link arrangement for the opening or closing of second gripper mechanism 4 similar to that used for the opening or closing of first gripper mechanism 2, that is with a motor 80, a driving member 21 and a release connecting link 23, the stationary arrangement of second gripper mechanism 4 may allow for omission of a connecting link. Such arrangements do not depart from the spirit of, or exceed the scope of the claimed invention. The embodiment presented represents a preferred embodiment in that common components may be used in the functionally corresponding components of the actuator and link arrangement providing the opening or closing functions of first gripper mechanism 3 and second gripper mechanism 4 thereby reducing the number of different components to be manufactured.

Still further, although the apparatus is described as having separate programmable controllers, it is noted here that individual programmable controllers could be combined in any combination even to the combination of a single programmable controller. In the first embodiment the controllers referenced herein being 91, 92, and 93. In the second embodiment the controllers referenced herein being 191, 192, and 193.

Although the invention has been described in terms of particular embodiments in an application, one of ordinary skill in the art, in light of the teachings herein, can generate additional embodiments and modifications without departing from the spirit of, or exceeding the scope of, the claimed invention. For example, actuators 71, 171 and 181, could be any actuator configured to produce a movement of pivot axis 17, 117 and 127 respectively in a direction generally perpendicular to the first direction of workpiece feeding.

Accordingly, it is understood that the drawings and the descriptions herein are proffered only to facilitate comprehension of the invention and should not be construed to limit the scope thereof.

What is claimed is:

1. An apparatus for the intermittent feeding of a workpiece, the apparatus comprising:

a first linearly guided gripper mechanism which is movable in a first direction of workpiece feeding and in a second direction opposite to the first direction, the first gripper mechanism comprising a first gripping member and a second gripping member wherein the second gripping member is movable relative to the first gripping member for gripping the workpiece;

a first release actuator for moving the second gripping member of the first gripper mechanism in a direction relative to the first gripping member of the first gripper mechanism;

a first release connecting link with a first end pivotally connected at a first pivot axis to the first release actuator and with a second end pivotally connected at a second pivot axis to the second gripping member of the first gripper mechanism; and a first programmable controller for controlling the actuation of the first release actuator;

wherein the second pivot axis of the first release connecting link is movable in the first direction of workpiece feeding and the second direction opposite to the first direction;

wherein the first release actuator is reversible; and wherein the reversible first release actuator comprises a rotary actuator and a driving member.

2. The apparatus of claim 1 wherein the direction of movement of the second gripping member of the first gripper mechanism relative to the first gripping member of the first gripper mechanism is generally perpendicular to the first direction of workpiece feeding.

3. The apparatus of claim 1 wherein the second pivot axis of the first release connecting link is arranged generally perpendicular to the direction of movement of the second gripping member of the first gripper mechanism relative to the first gripping member of the first gripper mechanism and is further arranged generally perpendicular to the first direction of workpiece feeding.

4. The apparatus of claim 1 wherein the driving member is a link.

5. The apparatus of claim 1 wherein the driving member is an eccentric.

6. The apparatus of claim 1 wherein the first release actuator and the programmable controller are configured to produce a gripping force onto the workpiece.

7. The apparatus of claim 1 wherein the first release actuator and the programmable controller are configured to determine a distance between the first and second gripping members of the first gripper mechanism such that a gap is provided between the workpiece and second gripping member that is optimal for a workpiece thickness.

8. An apparatus for the intermittent feeding of a workpiece, the apparatus comprising:

a first linearly guided gripper mechanism which is movable in a first direction of workpiece feeding and in a second direction opposite to the first direction, the first gripper mechanism comprising a first gripping member and a second gripping member wherein the second gripping member is movable relative to the first gripping member for gripping the workpiece;

a first release actuator for moving the second gripping member of the first gripper mechanism in a direction relative to the first gripping member of the first gripper mechanism;

a first release connecting link with a first end pivotally connected at a first pivot axis to the first release actuator and with a second end pivotally connected at a second pivot axis to the second gripping member of the first gripper mechanism; and a first programmable controller for controlling the actuation of the first release actuator;

wherein the second pivot axis of the first release connecting link is movable in the first direction of workpiece feeding and the second direction opposite to the first direction;

wherein the first release actuator is reversible; and wherein the reversible first release actuator comprises a linear actuator.

9. The apparatus of claim 8 wherein the direction of movement of the second gripping member of the first gripper mechanism relative to the first gripping member of the first gripper mechanism is generally perpendicular to the first direction of workpiece feeding.

10. The apparatus of claim 8 wherein the second pivot axis of the first release connecting link is arranged generally perpendicular to the direction of movement of the second gripping member of the first gripper mechanism relative to the first gripping member of the first gripper mechanism and is further arranged generally perpendicular to the first direction of workpiece feeding.

11. An apparatus for the intermittent feeding of a workpiece, the apparatus comprising:

a first linearly guided gripper mechanism which is movable in a first direction of workpiece feeding and in a second direction opposite to the first direction, the first gripper mechanism comprising a first gripping member and a second gripping member wherein the second gripping member is movable relative to the first gripping member for gripping the workpiece;

a first release actuator for moving the second gripping member of the first gripper mechanism in a direction relative to the first gripping member of the first gripper mechanism;

a first release connecting link with a first end pivotally connected at a first pivot axis to the first release actuator and with a second end pivotally connected at a second pivot axis to the second gripping member of the first gripper mechanism; and a first programmable controller for controlling the actuation of the first release actuator;

wherein the second pivot axis of the first release connecting link is movable in the first direction of workpiece feeding and the second direction opposite to the first direction;

wherein the first release actuator is reversible; and wherein the reversible first release actuator comprises a rotary motor, a threaded rod, and an internally threaded member.

12. An apparatus for the intermittent feeding of a workpiece, the apparatus comprising:

a first linearly guided gripper mechanism which is movable in a first direction of workpiece feeding and in a second direction opposite to the first direction, the first gripper mechanism comprising a first gripping member and a second gripping member wherein the second gripping member is movable relative to the first gripping member for gripping the workpiece;

a first release actuator for moving the second gripping member of the first gripper mechanism in a direction relative to the first gripping member of the first gripper mechanism;

a first release connecting link with a first end pivotally connected at a first pivot axis to the first release actuator and with a second end pivotally connected at a second pivot axis to the second gripping member of the first gripper mechanism; and a first programmable controller for controlling the actuation of the first release actuator;

wherein the second pivot axis of the first release connecting link is movable in the first direction of workpiece feeding and the second direction opposite to the first direction;

wherein the first release actuator is reversible; and wherein the first programmable controller is configured to move the second pivot axis of the first release connecting link prior to the movement of the first gripper mechanism in the first direction of workpiece feeding such that the distance between the first and second gripping members of the first gripper mechanism is decreased for gripping the workpiece.

13. An apparatus for the intermittent feeding of a workpiece, the apparatus comprising:

a first linearly guided gripper mechanism which is movable in a first direction of workpiece feeding and in a second direction opposite to the first direction, the first gripper mechanism comprising a first gripping member and a second gripping member wherein the second gripping member is movable relative to the first gripping member for gripping the workpiece;

a first release actuator for moving the second gripping member of the first gripper mechanism in a direction relative to the first gripping member of the first gripper mechanism;

a first release connecting link with a first end pivotally connected at a first pivot axis to the first release actuator and with a second end pivotally connected at a second pivot axis to the second gripping member of the first gripper mechanism; and a first programmable controller for controlling the actuation of the first release actuator;

wherein the second pivot axis of the first release connecting link is movable in the first direction of workpiece feeding and the second direction opposite to the first direction;

wherein the first release actuator is reversible; and wherein the first programmable controller is configured to move the second pivot axis of the first release connecting link during movement of the first gripper mechanism in the first direction of workpiece feeding such that the distance between the first and second gripping members of the first gripper mechanism remains constant.

14. An apparatus for the intermittent feeding of a workpiece, the apparatus comprising:

a first linearly guided gripper mechanism which is movable in a first direction of workpiece feeding and in a second direction opposite to the first direction, the first gripper mechanism comprising a first gripping member and a second gripping member wherein the second gripping member is movable relative to the first gripping member for gripping the workpiece;

a first release actuator for moving the second gripping member of the first gripper mechanism in a direction relative to the first gripping member of the first gripper mechanism;

a first release connecting link with a first end pivotally connected at a first pivot axis to the first release actuator and with a second end pivotally connected at a second pivot axis to the second gripping member of the first gripper mechanism; and a first programmable controller for controlling the actuation of the first release actuator;

wherein the second pivot axis of the first release connecting link is movable in the first direction of workpiece feeding and the second direction opposite to the first direction;

wherein the first release actuator is reversible; and wherein the first programmable controller is configured to move the second pivot axis of the first release connecting link at the end of movement of the first gripper mechanism in the first direction of workpiece feeding such that the distance between the first and second gripping members of the first gripper mechanism is increased for releasing of the workpiece.

15. An apparatus for the intermittent feeding of a workpiece, the apparatus comprising:

a first linearly guided gripper mechanism which is movable in a first direction of workpiece feeding and in a second direction opposite to the first direction, the first gripper mechanism comprising a first gripping member and a second gripping member wherein the second gripping member is movable relative to the first gripping member for gripping the workpiece;

a first release actuator for moving the second gripping member of the first gripper mechanism in a direction relative to the first gripping member of the first gripper mechanism;

a first release connecting link with a first end pivotally connected at a first pivot axis to the first release actuator and with a second end pivotally connected at a second pivot axis to the second gripping member of the first gripper mechanism; and a first programmable controller for controlling the actuation of the first release actuator;

wherein the second pivot axis of the first release connecting link is movable in the first direction of workpiece feeding and the second direction opposite to the first direction;

wherein the first release actuator is reversible; and wherein the first programmable controller is configured to move the second pivot axis of the first release connecting link during the movement of the first gripper mechanism in the second direction opposite to the first direction of workpiece feeding such that the distance between the first and second gripping members of the first gripper mechanism remains constant.

16. An apparatus for the intermittent feeding of a workpiece, the apparatus comprising:

a first linearly guided gripper mechanism which is movable in a first direction of workpiece feeding and in a second direction opposite to the first direction, the first gripper mechanism comprising a first gripping member and a second gripping member wherein the second gripping member is movable relative to the first gripping member for gripping the workpiece;

a first release actuator for moving the second gripping member of the first gripper mechanism in a direction relative to the first gripping member of the first gripper mechanism;

a first release connecting link with a first end pivotally connected at a first pivot axis to the first release actuator and with a second end pivotally connected at a second pivot axis to the second gripping member of the first gripper mechanism;

wherein the second pivot axis of the first release connecting link is movable in the first direction of workpiece feeding and the second direction opposite to the first direction;

a second linearly guided gripper mechanism which is movable in a first direction of workpiece feeding and in a second direction opposite to the first direction, the second gripper mechanism comprising a first gripping member and a second gripping member wherein the second gripping member is movable relative to the first gripping member for gripping the workpiece; and a second release actuator for moving the second gripping member of the second gripper mechanism in a direction relative to the first gripping member of the second gripper mechanism; and a second release connecting link with a first end pivotally connected at a first pivot axis to the second release actuator and with a second end pivotally connected at a second pivot axis to the second gripping member of the second gripper mechanism; and wherein the second pivot axis of the second release connecting link is movable in the first direction of workpiece feeding and the second direction opposite to the first direction.

17. The apparatus of claim 16 wherein the direction of movement of the second gripping member of the second gripper mechanism relative to the first gripping member of the second gripper mechanism is generally perpendicular to the first direction of workpiece feeding.

18. The apparatus of claim 16 wherein the second pivot axis of the second release connecting link is arranged generally perpendicular to the direction of movement of the second gripping member of the second gripper mechanism relative to the first gripping member of the second gripper mechanism and is further arranged generally perpendicular to the first direction of workpiece feeding.

19. The apparatus of claim 16 wherein the first and second release actuators are reversible.

20. The apparatus of claim 16 further comprising a first programmable controller for controlling the actuation of the first release actuator and a second programmable controller for controlling the actuation of the second release actuator.

21. The apparatus of claim 16 further comprising a programmable controller for controlling actuation of the first and second release actuators.

22. The apparatus of claim 16 further comprising;

a first gripper mechanism drive actuator which is angularly adjustable, reversible and rotary; and, a fixed length driving member connected to the first gripper mechanism drive actuator for rotation therewith; and, a first gripper mechanism drive connecting link with a first end pivotally connected to a first end of the fixed length driving member and with a second end pivotally connected to the first gripper mechanism for moving the first gripper mechanism in the first direction of workpiece feeding, and in the second direction opposite to the first direction; and, a second gripper mechanism drive connecting link with a first end pivotally connected to a second end of the fixed length driving member and with a second end pivotally connected to the second gripper mechanism for moving the second gripper mechanism in the first direction of workpiece feeding, and in the second direction opposite to the first direction.

23. The apparatus of claim 22 further comprising a first programmable controller for controlling the actuation of the first release actuator and a second programmable controller for controlling the actuation of the second release actuator and a third programmable controller for controlling the actuation of the first gripper mechanism drive actuator.

24. An apparatus for the intermittent feeding of a workpiece, the apparatus comprising:

a first linearly guided gripper mechanism which is movable in a first direction of workpiece feeding and in a second direction opposite to the first direction, the first gripper mechanism comprising a first gripping member and a second gripping member wherein the second gripping member is movable relative to the first gripping member for gripping the workpiece;

a first release actuator for moving the second gripping member of the first gripper mechanism in a direction relative to the first gripping member of the first gripper mechanism;

a first release connecting link with a first end pivotally connected at a first pivot axis to the first release actuator and with a second end pivotally connected at a second pivot axis to the second gripping member of the first gripper mechanism;

wherein the second pivot axis of the first release connecting link is movable in the first direction of workpiece feeding and the second direction opposite to the first direction;

a first gripper mechanism drive actuator which is angularly adjustable, reversible and rotary; and a fixed length driving member connected to the first gripper mechanism drive actuator for rotation therewith; and, a first gripper mechanism drive connecting link with a first end pivotally connected to a first end of the fixed length driving member and with a second end pivotally connected to the first gripper mechanism for moving the first gripper mechanism in the first direction of workpiece feeding, and in the second direction opposite to the first direction.

25. The apparatus of claim 24 further comprising a first programmable controller for controlling the actuation of the first release actuator and a second programmable controller for controlling the actuation of the first gripper mechanism drive actuator.

26. The apparatus of claim 24 further comprising a programmable controller for controlling actuation of the first release actuator and first gripper mechanism drive actuator.

27. The apparatus of claim 24 further comprising a programmable controller for controlling actuation of the first and second release actuators and first gripper mechanism drive actuator.

* * * * *